US007428390B2

(12) United States Patent
Ando

(10) Patent No.: US 7,428,390 B2
(45) Date of Patent: Sep. 23, 2008

(54) IMAGE FIXING APPARATUS WITH VARIABLE FIXING MODES

(75) Inventor: Atsutoshi Ando, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 11/459,488

(22) Filed: Jul. 24, 2006

(65) Prior Publication Data

US 2007/0025750 A1 Feb. 1, 2007

(30) Foreign Application Priority Data

Jul. 27, 2005 (JP) ..... 2005-217454
Oct. 5, 2005 (JP) ..... 2005-292582
Jul. 10, 2006 (JP) ..... 2006-189246

(51) Int. Cl.
*G03G 15/20* (2006.01)

(52) U.S. Cl. ..... 399/67; 399/45; 399/69; 399/82; 399/328

(58) Field of Classification Search ..... 399/67, 399/45, 82, 69, 328, 329; 219/216
See application file for complete search history.

(56) References Cited

U.S. PATENT DOCUMENTS

| | | | | |
|---|---|---|---|---|
| 5,525,775 | A | 6/1996 | Setoriyama et al. | 219/216 |
| 6,895,207 | B2 * | 5/2005 | Kataoka et al. | 399/328 |
| 7,177,579 | B2 | 2/2007 | Uchida et al. | 399/328 |
| 7,200,345 | B2 * | 4/2007 | Katayanagi et al. | 399/45 |
| 7,209,696 | B2 | 4/2007 | Umezawa et al. | 399/329 |
| 2003/0128994 | A1 * | 7/2003 | Holubek et al. | 399/45 |
| 2004/0033084 | A1 | 2/2004 | Akizuki et al. | 399/69 |
| 2004/0042810 | A1 | 3/2004 | Cho | 399/69 |
| 2004/0105693 | A1 * | 6/2004 | Akizuki et al. | 399/69 |
| 2004/0197112 | A1 * | 10/2004 | Saito et al. | 399/69 |
| 2004/0234290 | A1 | 11/2004 | Tomatsu | 399/67 |
| 2005/0117930 | A1 * | 6/2005 | Akizuki et al. | 399/69 |
| 2007/0116502 | A1 | 5/2007 | Shimizu et al. | 399/329 |

FOREIGN PATENT DOCUMENTS

| | | |
|---|---|---|
| CN | 1470956 | 1/2004 |
| CN | 1475875 | 2/2004 |
| JP | 2-132481 | 5/1990 |
| JP | 4-44075 | 2/1992 |
| JP | 6-11993 | 1/1994 |
| JP | 8-171303 | 7/1996 |
| JP | 10-10893 | 1/1998 |
| JP | 10-282828 | 10/1998 |
| JP | 2963168(B2) | 8/1999 |
| JP | 2004-279702 | 10/2004 |

* cited by examiner

*Primary Examiner*—Sophia S Chen
(74) *Attorney, Agent, or Firm*—Fitzpatrick, Cella, Harper & Scinto

(57) ABSTRACT

A fixing apparatus is provided, in which a problem such as the melting of a heater retaining member does not occur when a fixing nip portion performs a fixing processing in a reduced pressure state. In a fixing apparatus of an image forming apparatus capable of feeding a paper by applied pressures of two types or more, the fixing apparatus is changed to a mode in which the applied force is low, and is allowed to perform an operation for cooling the fixing apparatus before starting a current supply to a heater.

8 Claims, 18 Drawing Sheets

IMAGE FIXING APPARATUS WITH VARIABLE FIXING MODES

BACKGROUND OF THE INVENTION

1. Field of the Invention

The present invention relates to a fixing apparatus mounted on a copying machine or a printer, and in particular, it relates to a heater, a sleeve having its inner peripheral surface contacted with a heater, and a backup member for forming a fixing nip portion with the heater through the sleeve.

2. Description of the Related Art

In general, as a fixing apparatus mounted on a copying machine or a printer, a fixing apparatus of a film system has been put to practical use, which comprises a heater made of ceramic, a fixing film of material such as polyimide, stainless, and the like having its inner peripheral surface contacted with this heater, and a pressure roller for forming a fixing nip portion with the heater through the fixing film.

As one mode of this fixing apparatus of the film system, there is an apparatus providing an elastic layer such as a silicon rubber and the like for the fixing film. Due to the provision of the elastic layer for the fixing film, a toner image on the recording material can be fixed as though enwrapped. Consequently, this fixing apparatus is mainly used as a fixing apparatus mounted on a full-color printer.

Incidentally, the fixing film having an elastic layer is worse in heat transfer property of the fixing film than the fixing film having no elastic layer, and has such characteristic that heat of the heater is hard to travel from the inner surface to the front surface of the fixing film. Hence, there is a problem that, similarly to the case where the fixing film having no elastic layer is used, it is difficult to manage the temperature of the fixing nip portion to become the temperature suitable for fixing the toner by a temperature management method such as controlling current supply to the heater such that the temperature of the heater is detected and this detected temperature maintains at a set temperature of the fixing time period.

Hence, the fixing apparatus using the fixing film having the elastic layer adopts a temperature management method of controlling current supply to the heater such that the temperature of the fixing film is detected by a first temperature detection element and this detected temperature maintains at a set temperature of the fixing time period, so that the temperature of the fixing nip portion becomes a temperature suitable for the fixing of the toner. Further, by installing a second temperature detection element for detecting the temperature of the heater, an abnormal temperature rising of the heater is coped with. For example, when the detected temperature of the second temperature detection element exceeds a heat-resistance temperature of a heater holder, a control to shut off the current supply to the heater is performed.

By the way, in the recent copying machine or printer, a variety of media (recording material) used for the printer is diversified. Hence, to cope with a variety of media, the fixing apparatus must also set fixing conditions corresponding to the media.

As one of means for changing the fixing conditions, there is a method of changing a pressure applied to the fixing nip portion. For example, countermeasures can be considered where when print is made on an envelope, the pressure applied to the fixing nip portion is lowered than when print is made on a plain paper, thereby suppressing the generation of creases on the envelope. As a constitutional example making it possible to change an applied pressure of the fixing apparatus in this way, there exist Japanese Patent Application Laid-Open No. H6-11993 and Japanese Patent Application Laid-Open No. H10-282828.

Further, a technology for changing the fixing temperature when the applied pressure of the fixing apparatus is changed is also proposed. As such an example, for example, there exist Japanese Patent Application Laid-Open No. H02-132481 and Japanese Patent Application Laid-Open No. 2004-279702.

However, when the pressure applied to the fixing nip portion is lowered, the width in a recording material conveying direction of the fixing nip portion is narrowed. Hence, a contact area with the fixing film and the pressure roller becomes narrow, and efficiency of heat transfer from the fixing film to the pressure roller is lowered. Further, the efficiency of heat transfer from the heater to the fixing film is also lowered.

Hence, when the current supply is started for the heater in a state in which a pressure applied to the fixing nip portion is lowered (reduced pressure state), comparing with the case where the current supply is made without lowering the pressure (in case the input power is presumed to be the same), a temperature rising speed of the heater becomes fast. FIG. 5 shows a change of detected temperatures of a main thermistor (a first temperature detection element) and a sub-thermistor (a second temperature detection element) when the fixing nip portion is in a normal pressure state and in a reduced pressure state.

Particularly, when the pressure applied to the fixing nip portion is lowered and the current supply to the heater is started in a state in which the fixing apparatus is warmed up, there are often the cases where the heater reaches a high-temperature faster than the reaction of the second temperature detection element due to steep temperature rising of the heater. In such a case, melting of the heater holder made of resin is likely to occur. When the heater holder is melt, the pressure applied to the fixing nip portion is off its balance, thereby inviting negative effects such as non-uniformity of luster of an image and the like.

SUMMARY OF THE INVENTION

The present invention has been carried out in view of the above described problems, and an object of the invention is to provide a fixing apparatus capable of controlling abnormality of the apparatus even when a heater is operated in a state in which the pressure applied to a fixing nip portion is lowered.

Another object of the present invention is to provide a fixing apparatus comprising: a heater; a sleeve having an inner peripheral surface contacted with said heater; a backup member for forming a fixing nip portion with said heater through said sleeve; a first temperature detection element for detecting a temperature of said sleeve; a second temperature detection element for detecting a temperature of said heater; a current supply control portion for controlling a current supply to said heater so that the detection temperature of said first temperature detection element maintains at a set temperature; a pressure adjustment mechanism for adjusting a pressure applied to the fixing nip portion, said pressure adjustment mechanism being capable of setting the pressure applied to the fixing nip portion to a first pressure and a second pressure lower than the first pressure; wherein said fixing apparatus is capable of setting a first fixing mode for executing a fixing process under the first pressure and a second fixing mode for executing the fixing process under the second pressure, and wherein in case the detection temperature of said second temperature detection element before starting the fixing process under the second fixing mode is higher than a reference temperature, a time period from upon receipt of the print signal until starting the fixing process under the second fixing mode is longer than the case where the detection temperature is lower than the reference temperature.

Further objects of the present invention will become apparent from the following detailed description taken in connection with the accompanying drawings.

Further features of the present invention will become apparent from the following description of exemplary embodiments (with reference to the attached drawings).

DESCRIPTION OF THE EMBODIMENTS

Embodiments of the present invention will be described in detail.

First Embodiment (1) Example of Image Forming Apparatus

Figure 2:
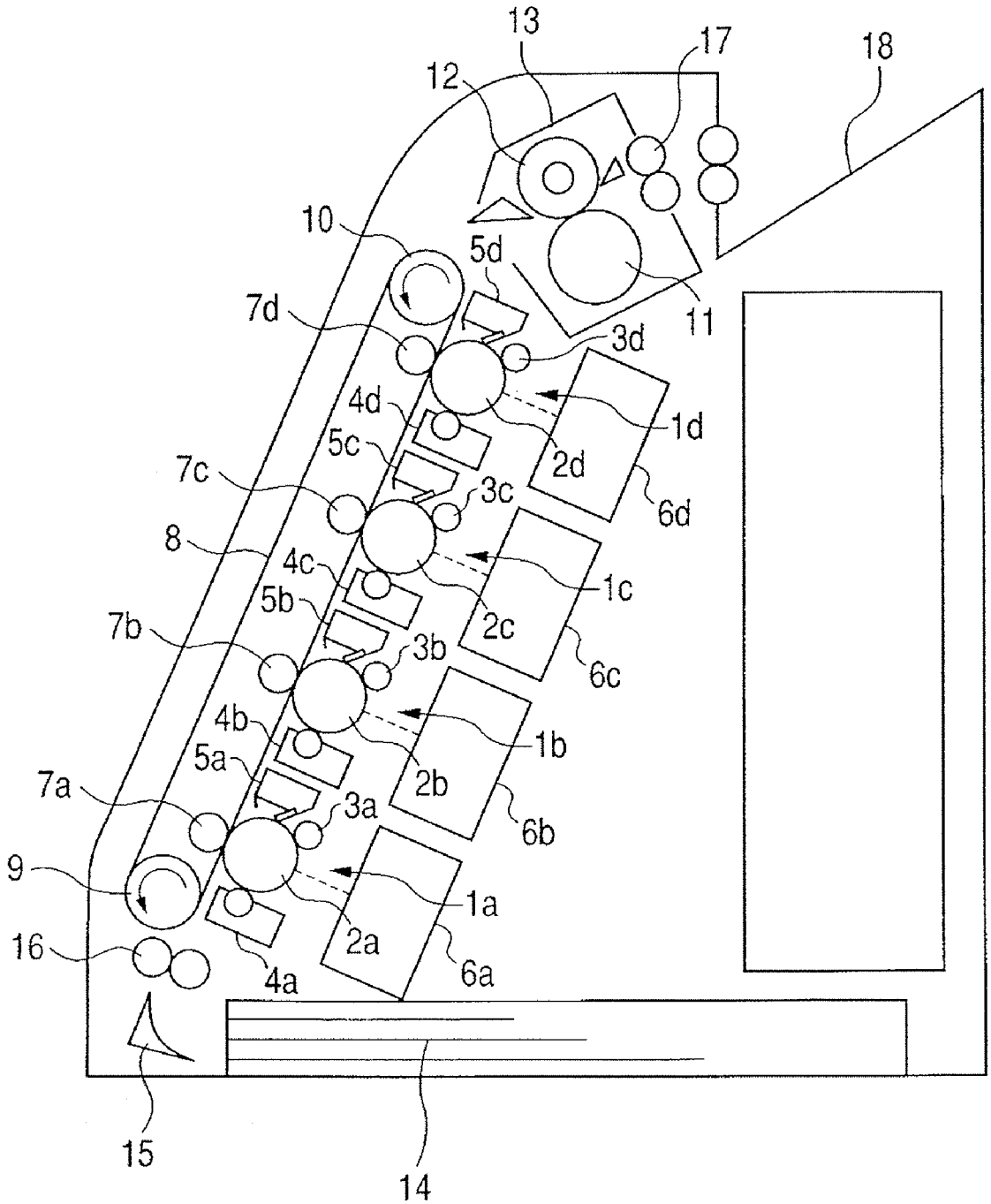
FIG. 2 is a sectional view of an image forming apparatus mounting a fixing apparatus of the present invention.

FIG. 2 is a constitutional model view of one example of an image forming apparatus mounting a fixing apparatus according to the present invention. The image forming apparatus shown in the present embodiment is a laser printer for use of an electrophotographic image forming process.

This image forming apparatus comprises four image forming portions (image forming unit) of an image forming portion 1*a* for forming an image of yellow color, an image forming portion 1*b* for forming an image of magenta color, an image forming portion 1*c* for forming an image of cyan color, and an image forming portion 1*d* for forming an image of black color. These four image forming portions 1*a*, 1*b*, 1*c*, and 1*d* are installed at constant intervals in a row.

Each of the image forming portions 1*a*, 1*b*, 1*c*, and 1*d* is installed with each of drum-shaped electrophotographic photosensitive members (hereinafter referred to as photosensitive drum) 2*a*, 2*b*, 2*c*, and 2*d* as image bearing members, respectively. In the periphery of each of the photosensitive drums 2*a*, 2*b*, 2*c*, and 2*d*, there is installed each of charging devices 3*a*, 3*b*, 3*c*, and 3*d*, and each of developing apparatuses 4*a*, 4*b*, 4*c*, and 4*d*, and each of drum cleaning apparatuses 5*a*, 5*b*, 5*c*, and 5*d*, respectively. Above between the charging device 3 and the developing apparatus 4, there is installed each of exposing apparatuses 6*a*, 6*b*, 6*c*, and 6*d*, respectively. Each of the developing apparatuses 4*a*, 4*b*, 4*c*, and 4*d* stores a yellow toner, a magenta toner, a cyan toner, and a black toner, respectively.

Each of the photosensitive drums 2*a*, 2*b*, 2*c*, and 2*d* is an OPC (organic photoconductor) having a negatively charged polarity, and comprises a photoconductive layer on a drum main body made of aluminum. The layer is rotationally driven at a predetermined process speed in an arrow mark direction (counter-clock wise) by a driving apparatus (main motor shown in FIG. 16). The charging devices 3*a*, 3*b*, 3*c*, and 3*d* as charging means uniformly charge each surface of the photosensitive drums 2*a*, 2*b*, 2*c*, and 2*d* by charging bias applied from a charging bias power supply (not shown) to the predetermined potential of a negative polarity.

The developing apparatuses 4*a*, 4*b*, 4*c*, and 4*d* allow a toner of each color to be adhered to each electrostatic latent image formed on each of the photosensitive drums 2*a*, 2*b*, 2*c*, and 2*d*, thereby developing (visualizing) the latent image as a toner image. As a developing method by the developing apparatuses 4*a*, 4*b*, 4*c*, and 4*d*, for example, a two-component contact developing method can be used, in which magnetic carrier mixed with toner particle is used as developer, and the latent image is conveyed by the magnetic force of the developer, and is developed in a contact state with each of the photosensitive drums 2*a*, 2*b*, 2*c*, and 2*d*.

Transferring rollers 7*a*, 7*b*, 7*c*, and 7*d* as transferring means are constituted by elastic members, and abut against each of the photosensitive drums 2*a*, 2*b*, 2*c*, and 2*d* at each of the transferring nip portions through a recording material conveying belt (hereinafter referred to as transferring belt) 8 in an endless belt state. Incidentally, here, while the transferring roller is used as the transferring means, a transferring blade may be used, which is applied with a high voltage when the toner image is transferred on a recording material, and moreover, abuts against a transferring belt 8.

Drum cleaning apparatuses 5*a*, 5*b*, 5*c*, and 5*d* remove and collect transferring residual toners left over the surfaces of the photosensitive drums 2*a*, 2*b*, 2*c*, and 2*d*.

Exposure devices 6*a*, 6*b*, 6*c*, and 6*d* output a laser beam modulated by corresponding to a time sequence electric digital pixel signal of image information from a laser output portion (not shown). This apparatus exposes each surface of the photosensitive drums 2*a*, 2*b*, 2*c*, and 2*d* through a polygon mirror (not shown) and the like which revolve at high velocity, so that each surface of the photosensitive drums 2*a*, 2*b*, 2*c*, and 2*d* charged by each of the charging devices 3*a*, 3*b*, 3*c*, and 3*d* is formed with an electrostatic latent image of each color corresponding to image information.

The transferring belt 8 is spanned between a driving roller 9 and a tension roller 10, and is rotated (moved) in an arrow mark direction (counter-clock wise) by the driving of the driving roller 9. The transferring belt 8 is constituted by dielectric resin such as polycarbonate, polyethylene terephthalate resin film, polyfluorovinylidene resin film, and the like.

Further, at the down stream side of the recording material conveying direction of the transferring belt 8, there is installed a fixing device 13 comprising a fixing film (sleeve) 11 and a pressure roller (backup member) 12, which contain a heat source. Further, the image forming apparatus is installed with an unillustrated fan, and when the image forming apparatus rises in temperature due to heat generated by an electrical substrate and the fixing apparatus, the fan operates such that an air current is generated by the fan, so that the image forming apparatus can be cooled.

Next, an image forming operation by the image forming apparatus will be described.

When an image forming starting signal is emitted, each of the photosensitive drums 2*a*, 2*b*, 2*c*, and 2*d* of each of the image forming portions 1*a*, 1*b*, 1*c*, and 1*d* rotationally driven at the predetermined process speed (120 mm/sec) is uniformly charged to a negative polarity by each of the charging devices 3*a*, 3*b*, 3*c*, and 3*d*. Each of the 6*a*, 6*b*, 6*c*, and 6*d* converts the image signal of an output image into an optical signal by a laser output portion (not shown), and the laser beam which is a converted optical signal applies a scan exposure on each of the charged photosensitive drums 2*a*, 2*b*, 2*c*, and 2*d*, thereby forming an electrostatic latent image.

First, a yellow toner is allowed to adhere to the electrostatic latent image formed on the photosensitive drum 2*a* by the developing apparatus 4*a* applied with a developing bias of the same polarity as the charging polarity (negative polarity) of the photosensitive drum 2*a*, thereby visualizing the yellow toner as an toner image.

Timed with the movement of a leading end of the toner image on the photosensitive drum 2*a* toward a transferring portion between the photosensitive drum 2*a* and the transferring roller 7*a*, a recording material (sheet) (not shown) fed from a sheet feeding cassette 14 through a recording material conveying guide 15 is conveyed to a transferring portion Ta by a registration roller 16. Then, on the recording material P conveyed to the transferring portion, a toner image of yellow is transferred on the recording material by the transferring roller 7*a* applied with a polarity reverse to the transferring bias toner (positive polarity).

The recording material transferred with the toner image of yellow is moved to the image forming portion 1*b* by the recording material conveying belt 8. Then, in the transferring portion also, which is constituted by the image forming portion 1*b* and a transferring roller 7*b*, similarly to the above, the toner image of magenta formed on the photosensitive drum 2*b* is superposed and transferred on the toner image of yellow on the recording material.

Subsequently in the same manner, on the toner images of yellow and magenta superposed and transferred on the recording material, the toner images of cyan and black formed by the photosensitive drums 2*c* and 2*d* of the image forming portions 1*c* and 1*d* are superposed and transferred in order by each of transferring portions, thereby forming a toner image of full color on the recording material.

The recording material formed with the toner image of full color is conveyed to the fixing device 13, and by the fixing nip between the fixing film 11 and the pressure roller 12, the toner image of full color is heated and applied with pressure so as to be heat-fixed on the recording material surface, and after that, it is discharged on a discharge tray 18 by a discharge roller 17, thereby completing a series of image forming operations.

When the above described image is transferred to the recording material from the photosensitive drum, the transferring residual toners remained on each of the photosensitive drums 2*a*, 2*b*, 2*c*, and 2*d* are removed and collected by each of the drum cleaning apparatuses 5*a*, 5*b*, 5*c*, and 5*d*, respectively.

When a monochrome image is to be outputted, the above described image forming process is performed only by the image forming portion 1*d* for forming an image of black color.

Next, the fixing apparatus in the present embodiment will be described by using FIGS. 3 and 15.

Figure 3:
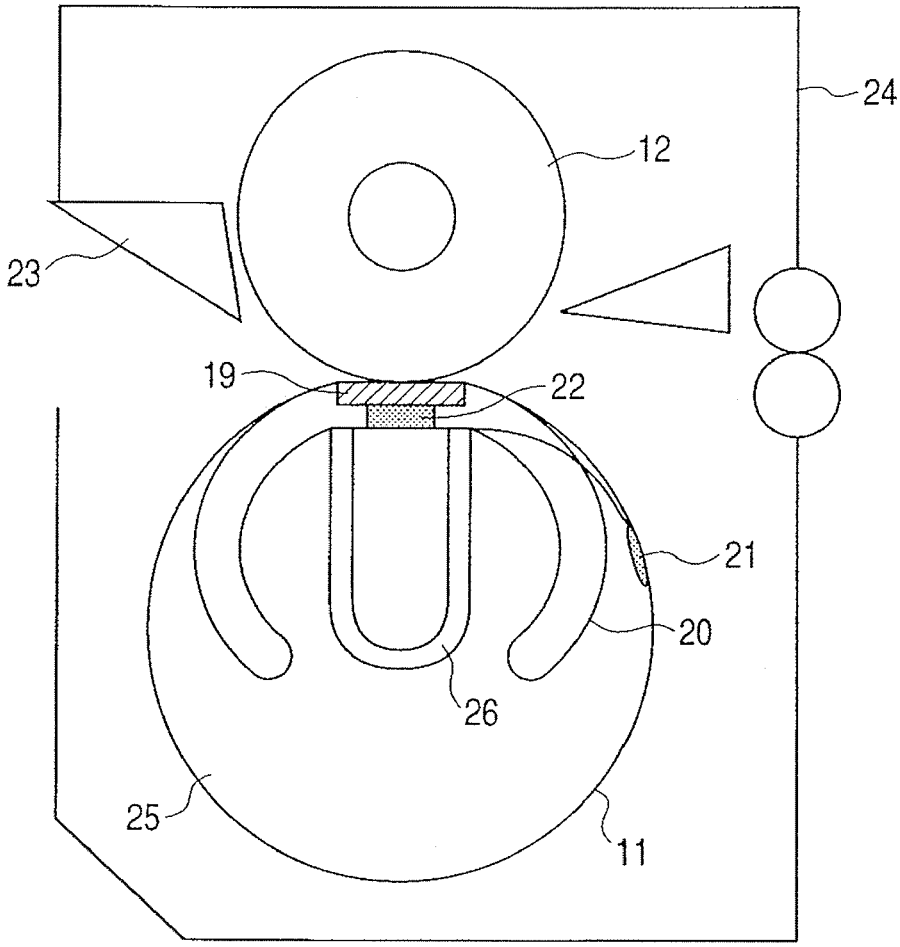
FIG. 3 is a sectional view of the fixing apparatus applied to the present invention.

FIG. 3 is an enlarged section view of the fixing apparatus shown in FIG. 2.

The fixing apparatus in the present embodiment comprises a heater 19, a heater holder 20, a main thermistor (first temperature detection element) 21, a sub-thermistor (second temperature detection element) 22, a fixing film (sleeve) 11, a pressure roller (backup member) 12, and an entry guide 23.

The heater holder 20 is formed by liquid crystal polymer resin having high heat resistance, and plays a role of retaining the heater 19 and a role of guiding the fixing film 11. In the present embodiment, as liquid crystal polymer, Zenite 7755 (name of product by DuPont) was used. The maximum usable temperature of Zenite 7755 is approximately 270° C.

The main thermistor 21 is installed in order to detect the temperature of the inner surface of the fixing film 11 and perform temperature adjustment.

The main thermistor 21 has a thermistor element attached to the arm top end made of stainless, and by the rocking of the arm, even when the movement of the inner surface of the fixing film 11 is put into an unstable state, the thermistor element is kept in a state always to contact the inner surface of the fixing film 11.

Figure 15:
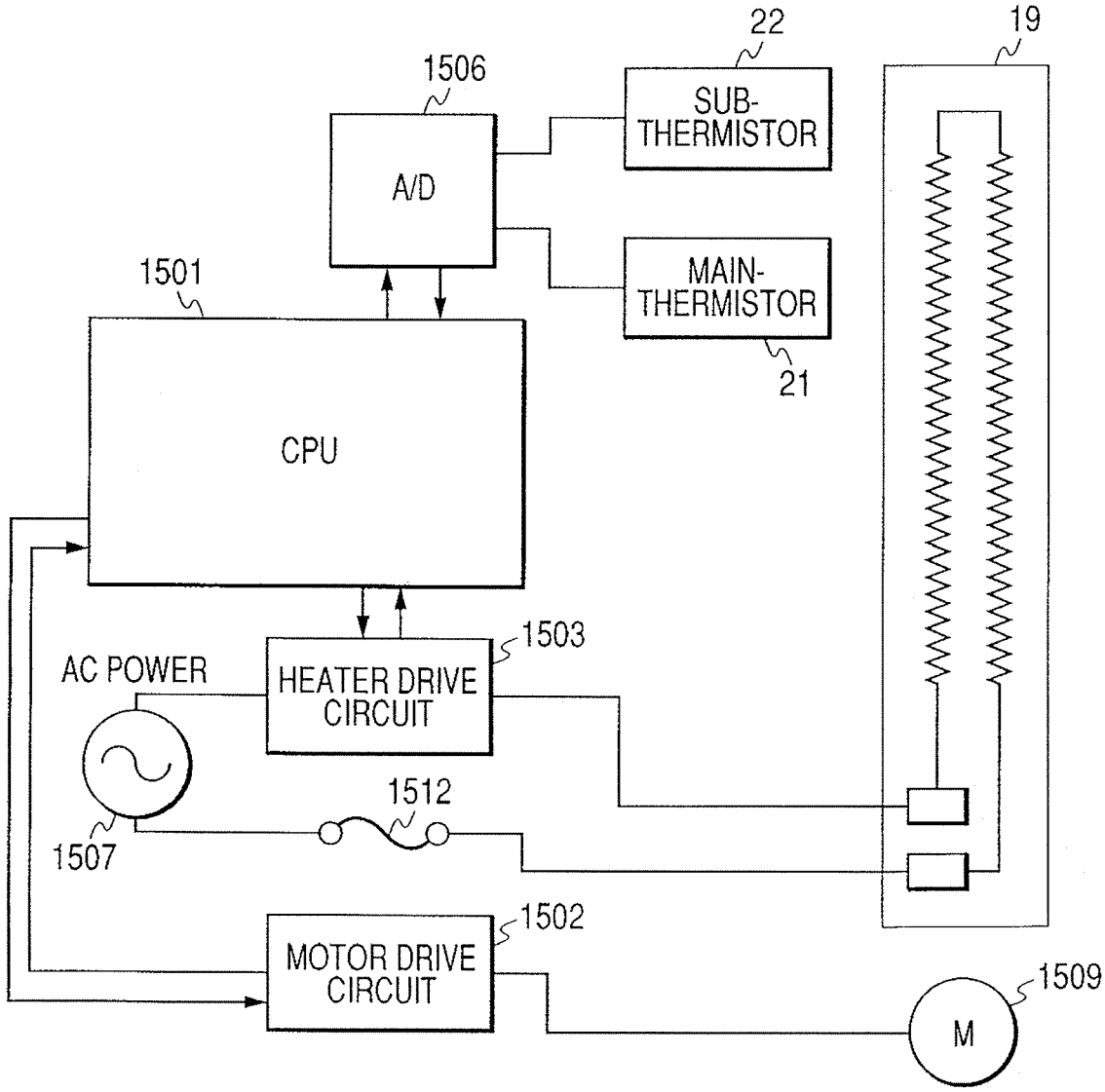
FIG. 15 is a block diagram showing an electrical constitution of the fixing apparatus of the present invention.

The thermistor 21, as shown in FIG. 15, is connected to a CPU 1501 through an A/D converter 1506. The CPU 1501, based on the output of the main thermistor 21, decides temperature control details of the heater 19, and controls a heater drive circuit 1503, thereby controlling the current supply to the heater 19. That is, the CPU 1501 bears a part of the current supply control portion for controlling the current supply to the heater, and this current supply control portion controls the current supply to the heater so that the detected temperature of the main thermistor 21 maintains at a set temperature. The set temperature of the present embodiment is 170° C.

The sub-thermistor 22, as shown in FIG. 15, is connected to the CPU 1501 through the A/D converter 1506. This sub-thermistor 22 is arranged at the rear surface of the heater 19.

When the end portion of the heater 19 excessively rises in temperature for some reason, the CPU 1501 lowers the set temperature of the heater. In this manner, the sub-thermistor 22 plays a role of trigger for performing a limiter control of the temperature rising of the heater 19. In the present embodiment, the sub-thermistor 22 is arranged at the end portion (area in which a small sized paper does not pass through) in a longitudinal direction of the heater 19, and detects the temperature rising of the end portion of the fixing apparatus 13 when a small sized paper passes through or the like. When the CPU 1501 determines that the end portion rises in temperature, by performing a control for lowering the fixing temperature (set temperature), an excessive temperature rising of the fixing apparatus is prevented. In the present embodiment, a judgement temperature (first judgement temperature) of the sub-thermistor 22 for lowering the set temperature of the heater 19 is set at 250° C. Further, a judgement temperature (second judgement temperature) for shutting off the current supply to the heater 19 is also set. The second judgement temperature of the sub-thermistor 22 is set approximately at the same temperature of 270° C. as the heat resistance temperature of the heater holder 20.

The fixing apparatus of the present embodiment further operates by abnormal temperature rising of the heater 19, and comprises a temperature fuse (thermal element) 1512, which shuts off the current supply to the heater 19 from a power source 1507. The operating temperature of this temperature fuse 1512 is also set to 270° C. approximately the same as the heat resistance temperature of the heater holder 20.

The fixing film 11 comprises a SUS film (base layer) formed in the shape of a seamless belt having a thickness of 50 μm by the drawing process of a bare pipe of SUS (stainless). Further, the fixing film 11 is comprised by forming a silicon rubber layer on the base layer by a ring coat method, and further, coating a PFA resin tube having a thickness of 30 μm on top of that layer as a mold release property layer. For the silicon rubber layer, it is desirable to make the most of a material having as much high heat conductivity as possible. That is, making a heat capacity of the fixing film 11 small is desirable in the light of shortening the time required for the temperature startup after commencing the current supply to the heater. The silicon rubber layer of the present embodiment is about $1.0\times10^{-3}$ cal/sec·cm·K in heat conductivity, and is a material belonging to the category having a high heat conductivity as a silicon rubber.

On the other hand, in view of an image quality necessary to strengthen a permeability factor of OHT (overhead transparency) and control a fine gloss irregularity, it is desirable to make the silicon rubber layer of the fixing film 11 as much thick as possible. According to the researches conducted by the present inventor and others, to obtain an image quality to the extent of a satisfactory level, it is found that a thickness of rubber is required to be above 200 μm.

The silicon rubber layer in the present embodiment is 250 μm in thickness taking into consideration heat conductivity and image quality of the silicon rubber layer. Further, the inner diameter of the fixing film 11 in the present embodiment is 24 mm.

When a heat capacity of the fixing film 11 thus formed is measured, it is $2.8\times10^{-2}$ cal/cm$^2$K (heat capacity per 1 cm$^2$ of the fixing film 11). In general, when the heat capacity of the fixing film 11 is above 1.0 cal/cm$^2$K, a temperature startup becomes slow, and an on-demand property is harmed. Further, inversely, when an attempt is made to reduce the heat capacity below $1.0\times10^{-2}$ cal/cm$^2$K, there is no alternative but to make the rubber layer of the fixing film 11 extremely thin, and it is no longer possible to secure a thickness of the rubber layer required to maintain an image quality such as the level and the like of OHT permeability and gloss irregularity. Hence, it is clear that a heat capacity of the fixing film 11 satisfying both of the on-demand property and the image quality is included in the range of not less than $1.0\times10^{-2}$ cal/cm$^2$K and not more than 1.0 cal/cm$^2$K.

Further, by providing a fluorinate resin layer on the surface of the fixing film 11, a mold release property of the surface of the fixing film 11 is improved, thereby preventing an offset phenomenon occurring when the toner is once adhered to the surface of the fixing film 11 and is moved again to the recording material.

Further, by making a mold release property layer (not shown) on the surface of the fixing film 11 into a PFA tube, it is possible to more simply form a mold release property layer having a uniform thickness.

The pressure roller 12 is comprised by forming a silicon rubber layer of approximately 3 mm in thickness on a cored bar made of stainless by injection molding and covering a PFA resin tube of approximately 40 μm in thickness on that rubber layer.

The entry guide 23 plays a role of guiding the recording material such that the recording material having passed through a secondary transferring nip is accurately guided to the fixing nip portion. The entry guide 23 of the present embodiment is formed by polyphenylene sulfide (PPS) resin.

The pressure roller 12 and the entry guide 23 are fitted to a frame 24, respectively.

Below the frame 24 is installed a fixing film unit 25 incorporating the fixing heater 19 mounted on the heater holder 20, the main thermistor 21, and the sub-thermistor 22. The fixing film unit 25 is pressured toward the pressure roller 12 by a force of 20 kgf (10 kgf at one side) by a pressure mechanism (FIGS. 1A to 1C) provided on both ends in the longitudinal direction of the fixing apparatus through a stay 26 made of metal in the shape of U letter installed along the heater holder 20.

In the fixing apparatus of the present embodiment, the pressure roller 12 is rotated so that the fixing film 11 is driven-rotate. At this time, the inner surface of the fixing film 11 and the heater holder 20 are configured to slide with each other. The inner surface of the fixing film 11 is coated with grease, so that sliding property between the heater holder 20 and the inner surface of the fixing film 11 is secured. The pressure roller 12 is driven by a fixing device motor 1509 shown in FIG. 15. This motor 1509 is controlled by a motor drive circuit 1502, and the motor drive circuit 1502 is controlled by the CPU 1501.

In the normal use, accompanied with the rotation start of the pressure roller 12, the fixing film 11 starts a driven rotation. Further, by the start of the current supply to the heater 19, the temperature of the heater 19 rises, and the inner surface temperature of the fixing film 11 also rises.

Next, the electrical structure of the fixing apparatus of the present embodiment will be described by using a block diagram of FIG. 15.

When a printer engine receives a print signal from an external device such as a personal computer and the like, the CPU 1501 transmits a drive start signal to the motor drive circuit 1502 and the heater drive circuit 1503 by a predetermined timing. The A/D converter 1506 applies A/D conversion to the signals from the main thermistor 21 and the sub-thermistor 22, and transmits them to the CPU 1501. The CPU 1501, based on the detected temperatures of the main thermistor 21 and the sub-thermistor 22, controls the heater drive circuit 1503, and supplies a necessary power to the heater 19 from an AC power supply 1507.

Next, by using FIGS. 1A to 1C and 4, a pressure adjustment mechanism in the present embodiment will be described.

Figure 1A:
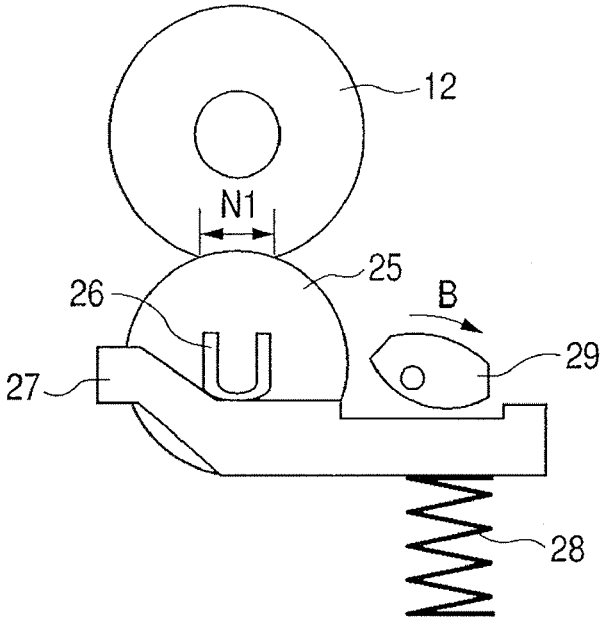
FIG. 1A is a view showing a first pressure state of a fixing apparatus of the present invention.
Figure 1B:
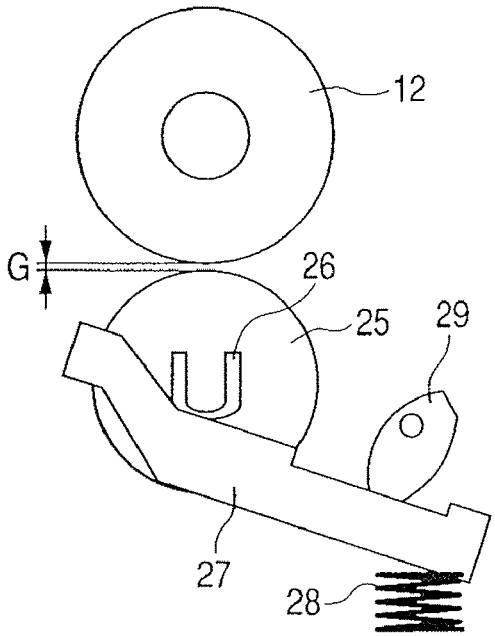
FIG. 1B is a view representing a pressure released state.
Figure 1C:
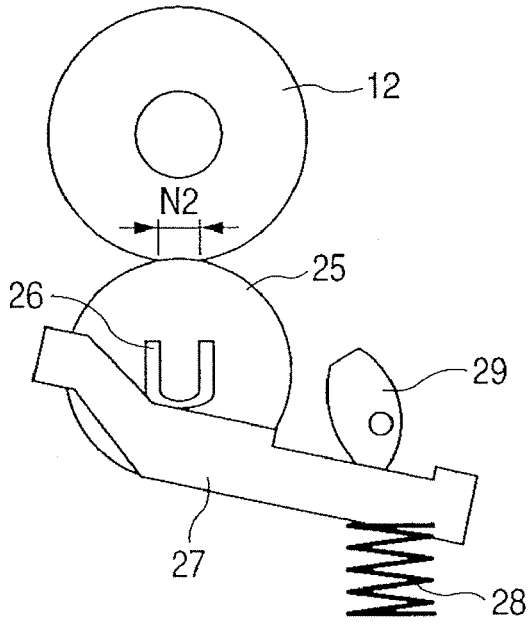
FIG. 1C is a view representing a second pressure state.

FIGS. 1A to 1C are schematic illustrations of the pressure adjustment mechanism of the fixing device 13 in the present embodiment. In the present embodiment, by changing the phase of a cam 29, a pressure applied to the fixing nip portion formed by the heater 19 and the pressure roller 12 can be adjusted.

FIG. 1A shows a state in which the pressure applied to the fixing nip portion is set to a first pressure. FIG. 1B shows a pressure released state in which the fixing film unit 25 is separated from the pressure roller 12. Further, FIG. 1C shows a state in which the pressure applied to the fixing nip portion is set to a second pressure lower than the first pressure.

As shown in FIG. 1A, both end portions in the longitudinal direction of the stay 26 of the fixing apparatus are provided with a pressure spring 28, a lever 27, and the cam 29 for pressuring the stay 26 by a predetermined pressure, respectively. This predetermined pressure is optimized by fixing ability and carrier property of the recording material, and usually is set in the range of 10 to 50 kgf. Between the fixing film unit 25 and the pressure roller 12, a nip N1 is secured. The came 29 is installed by approximately opposing to the pressure spring 28 by sandwiching the lever 27. The cam 29 is configured to be capable of rotating by an unillustrated drive source in the direction to an arrow mark B with an axis of rotation as a center.

Figure 4:
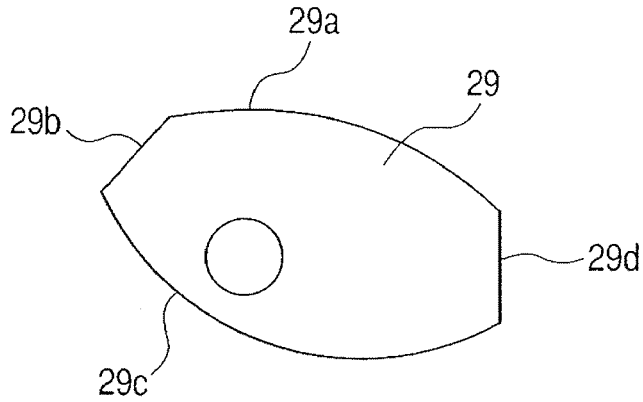
FIG. 4 is a view showing a shape of a cam which is a part of a pressure adjusting mechanism.

The cam 29, as shown in FIG. 4, is configured by four cam surfaces 29*a* to 29*d*.

FIG. 1A is a view showing a normal pressure state of the fixing apparatus. In this figure, the cam surface 29*c* of the cam 29 is opposed to the lever 27, and the cam surface 29*c* is in a non-contact state to the lever 27. Hence, a force for pressuring the fixing film unit 25 to the pressure roller is totally decided by the pressure spring 28 only. This normal pressure state (a state of the first pressure) is set at the time of the first fixing mode for applying a fixing processing to the plain paper formed with a toner image.

Next, the pressure released state shown in FIG. 1B is set at the time such as when paper clogging developed during image output is processed, when the image forming apparatus enters a low-power mode in case it is not used for a definite period of time, and when the power supply to the main body of the image forming apparatus is shut down and the like. This state is realized by setting the phase of the cam 29 to the position of FIG. 1B to prevent unnecessarily high voltage from being applied to the pressure roller 12 and the fixing film unit 25. Specifically, the cam 29 is rotated approximately 90 degrees clock-wise from the phase shown in FIG. 1A. In a state of FIG. 1B, the cam surface 29*d* of the cam 29 pushes down the lever 27 by opposing to a biasing force of the pressure spring 28, and retains a posture of the came 29 in a state of FIG. 1B by the cam surface 29*d* of a flat shape. In this manner, a gap G occurs between the fixing film unit 25 and the pressure roll 12. This gap G may have a distance to the extent of making it easy to perform an operation of removing a media (recording material) having caused paper clogging from the fixing apparatus. Incidentally, the gap G is not always necessary, and if a pressure applied to the fixing nip portion is reduced to the extent of sufficiently enough to easily remove the media having caused paper clogging, the Gap may be zero.

After having performed a processing to remove the jammed media in a state of FIG. 1B, in case a pressure state as shown in FIG. 1A is revived from this pressure released state in order to enable the main body of the image forming apparatus to output an image, the cam 29 is rotated approximately 270 degrees again in the direction of the arrow mark B from the phase of FIG. 1B, and the cam surface 29*c* is put into a state opposing to the lever 27.

Further, the fixing apparatus in the present embodiment, as shown in FIG. 1C, can be set to a half pressure state (state of the second pressure) in midway between the normal pressure state and the pressure released state. To realize the half pressure state, the cam 29 may be rotated approximately 270 degrees clock-wise from the phase of FIG. 1A. In s state of FIG. 1C, the cam surface 29*b* pushes down the lever 27 by opposing to a biasing force of the pressure spring 28, and retains the posture of the cam 29 in a state of FIG. 1C by the cum surface 29*b* of a flat shape. However, a pushed down amount of the lever 27 by the cam surface 29*b* is set smaller than the pushed down amount of the lever 27 by the cam surface 29*d*. Hence, in a state shown in FIG. 1C, though the pressure roller 12 and the fixing film unit 25 maintain an abutting state, comparing with the normal pressure state shown in FIG. 1A, the pressure applied to the fixing nip portion is low. Therefore, in a state of FIG. 1C, a nip N2 having a width narrower than the nip width N1 in the normal pressure state is formed. This half pressure state (state of the second pressure) is set at the time of the second fixing mode for applying a fixing processing to an envelope formed with the toner image.

Incidentally, in the present embodiment and all the embodiments to be described later, after having completed the print by the second fixing mode, the phase of the cam 29 is controlled such that the pressure applied to the fixing nip portion is restored from the second pressure to the first pressure.

In the present embodiment, the lever 27 is pushed down by the cam surface 29*d*, so that the lever 27 moves downward approximately by 1.5 mm more than the case of a state in FIG. 1A. In this manner, at the normal pressure time, the nip N1 having a width of approximately 8.5 mm in the conveying direction of the recording material becomes the nip N2 having a width of approximately 4 mm.

Figure 5:
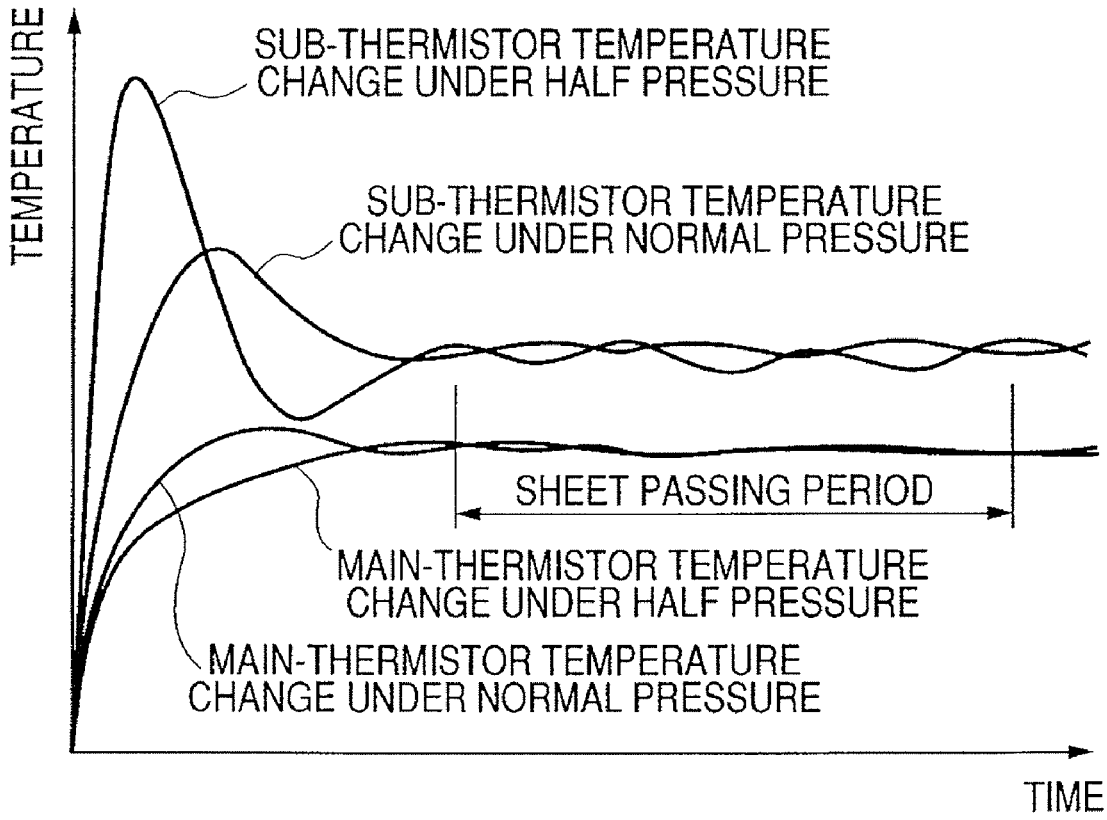
FIG. 5 is a graph showing a temperature changes of a heater and a fixing film when a predetermined power is inputted to the heater in the first pressure state and a predetermined power is inputted to the heater in the second pressure state.

In FIG. 5 is shown a temperature rising curve of the fixing apparatus when a constant power is inputted to the heater 19 by the normal pressure state (first fixing mode) and the half pressure state (second fixing mode). The temperatures of the main thermistor 21 and the sub-thermistor 22 at the time when a constant power is inputted to the heater 19 are monitored from the room temperature, respectively, and are plotted in a graph. As shown in FIG. 5, comparing with the normal pressure state, in the half pressure state, the temperature rising of the main thermistor becomes slow, while the temperature rising speed of the sub-thermistor becomes very steep. This is because heat supply from the heater to the fixing film is small in the half pressure state comparing with the normal pressure state, and from among the power inputted to the heater, a ratio of the power used for the temperature rising of the fixing film is small, so that the heater temperature is relatively easy to rise.

Next, a part of the temperature control in the present embodiment will be described by using FIG. 6. Incidentally, at a point of step S601 of FIG. 6, it is presumed that the fixing nip is in a state of FIG. 1A, that is, in the first pressure state.

At step S602, a mode selection is performed, and at step S603, it is determined whether or not the selected mode is an envelope mode. If the selected mode is not an envelope mode, at step S608, with the fixing apparatus set to the first pressure state as it is, the rotation of the motor 1509 and the current supply to the heater 19 are both started, and the normal print operation (fixing processing operation) is performed.

If the selected mode is an envelope mode, at step S604, the pressure adjusting mechanism is operated, and the pressure state is changed to the half pressure state (second pressure state), and after that, at steps S605 and S606, the sub-thermistor detected temperature is found. As a result, if the sub-thermistor temperature is above 80° C. which is a reference temperature, at step S607, the current supply to the heater 19 is not performed, but the rotation only of the motor 1509 is started, thereby performing a fixing apparatus cooling operation. After that, the current supply to the heater 19 is started to perform a normal print. If the temperature of the sub-thermistor 22 is below 80° C. which is a reference temperature, this cooling operation is not performed, but the rotation of the motor 1509 and the current supply to the heater 19 are both started, thereby starting a print.

Referring to details of the cooling operation, the fixing apparatus is driven (motor 1509 is driven) in a state in which the power is not inputted to the heater 19, and while monitoring the temperature of the sub-thermistor 22, a control to enter the normal print operation is performed at a point of the time when the temperature of the sub-thermistor 22 is lowered to 80° C.

Figure 6:
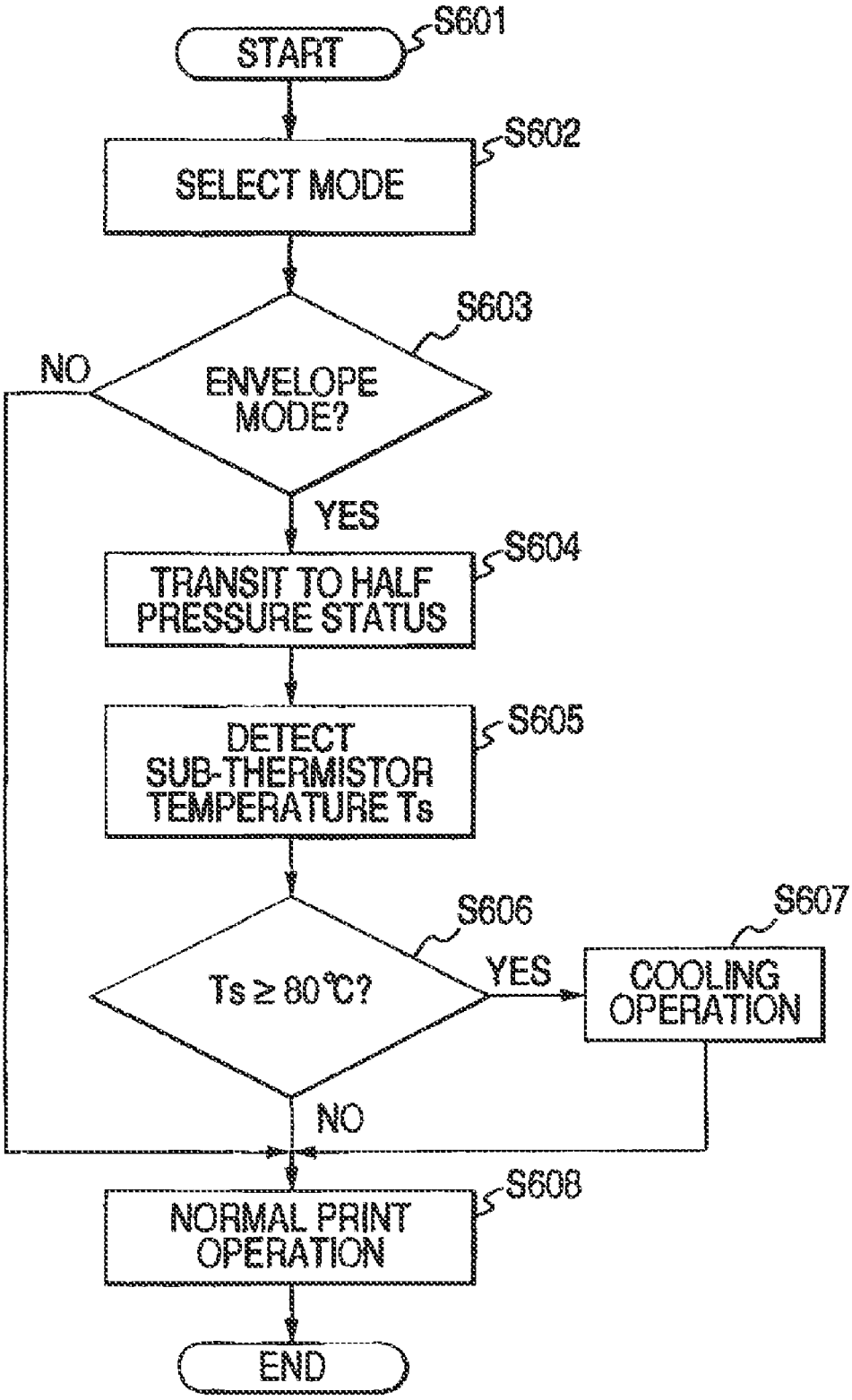
FIG. 6 is a flowchart showing the control of a first embodiment.
Figure 16:
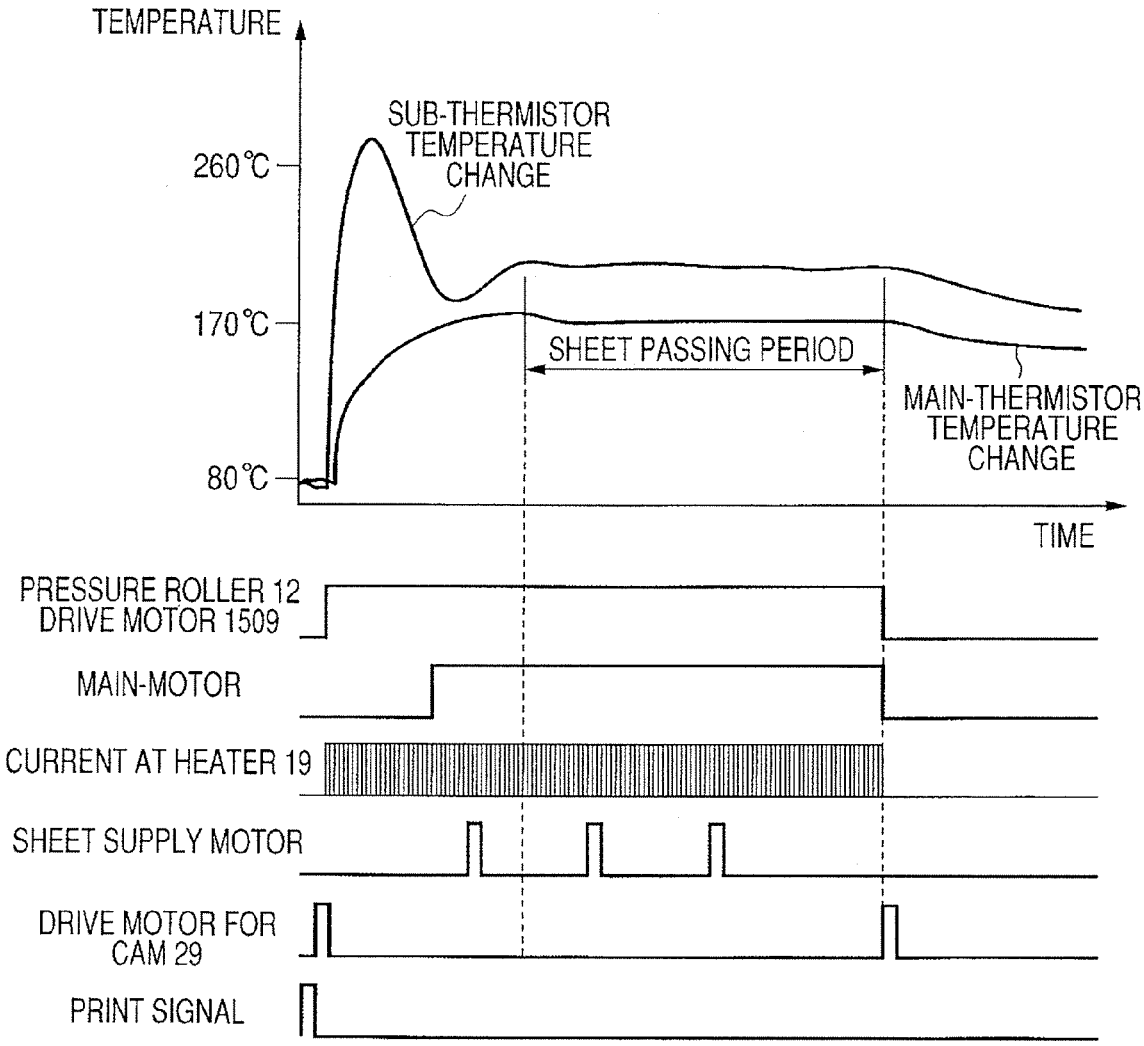
FIG. 16 is a view showing the operation of the first embodiment in case the temperature of a heater 19 is below 80° C. when the fixing nip portion is set to a state of FIG. 1C and a temperature changes of the heater and the fixing film when this operation is executed.
Figure 17:
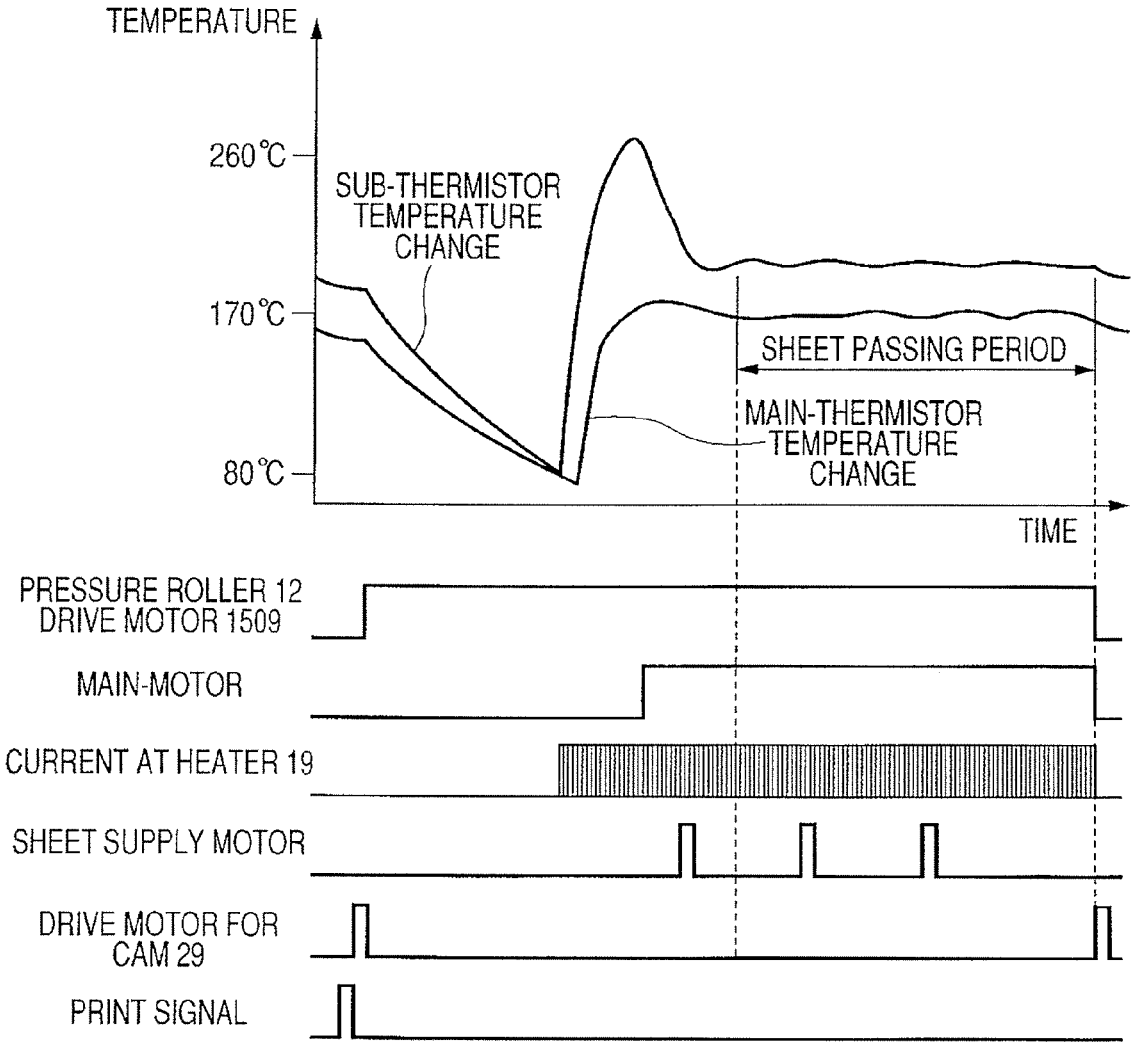
FIG. 17 is a view showing the operation of the first embodiment in case the temperature of a heater 19 is above 80° C. when the fixing nip portion is set to a state of FIG. 1C and a temperature changes of the heater and the fixing film when this operation is executed.

FIGS. 16 and 17 show a temperature change of the main thermistor 21 and the sub-thermistor 22 in case the second fixing mode (envelope mode) shown in FIG. 6 is executed. The main motor is a motor for driving a photosensitive drum 2 and a developing device 4, and a paper feeding motor is a motor to drive a roller feeding the recording material from the paper feeding cassette 14. Further, the CPU 1501 controls the heater drive circuit 1503 so that the detected temperature of the main thermistor 21 maintains a set temperature of 170° C.

FIG. 16 shows a case where the temperature of the heater 19 is below 80° C. when the fixing nip portion is set to a state of FIG. 1C by inputting the print signal to the printer engine.

As shown in FIG. 16, in case the temperature of the heater 19 is below 80° C., since the detected temperature of the sub-thermistor 22 is below 80° C., the current supply to the heater 19 is also started at the same time the driving of the motor 1509 for driving the pressure roller 12 is started. Then, at a point of time when the detected temperature of the main thermistor 21 reaches a set temperature sufficiently enough for performing the fixing processing of the toner image, a paper feeding motor is operated, and a paper feeding is started. After the toner image is formed on the recording material by the image forming portion, the recording material rushes into the fixing nip N2, and is applied with the fixing processing at the fixing nip portion N2. In FIG. 16, operation in case of three papers of the recording materials being continuously fed is shown. At a point of the time when the third recording material is discharged from the fixing device, the current supply to the heater 19 and the driving of the motor 1509 and the main motor are all stopped, and the image forming operation is completed.

At this time, though the detected temperature of the sub-thermistor 22, that is, the temperature of the heater 19 temporarily reaches to the vicinity of 270° C. by over-shooting, it will not exceed the heat resistance temperature 270° C. of the heater holder 20. Incidentally, when the detected temperature of the main thermistor 21 rises, the input power to the heater 19 is controlled, so that the temperature (detected temperature of the sub-thermistor 22) of the heater 19 falls down with somewhere in the vicinity of 270° C. as a peak. After that, when the fixing processing is performed at the fixing nip portion N2, the detected temperature of the sub-thermistor 22 changes in the vicinity of 270° C.

FIG. 17 shows a case where the temperature of the heater 19 is above 80° C. at the time when the fixing nip portion is set to a state of FIG. 1C by inputting the print signal into the printer engine.

As shown in FIG. 17, in case the temperature of the heater 19 is above 80° C., since the detected temperature of the sub-thermistor 22 is above 80° C., though the driving of the motor 1509 for driving the pressure roller 12 is started, the start of the driving of the motor 1509 and the current supply to the heater 19 are not synchronized. In other words, the time before the start of the current supply to the heater 19 from the time when the print signal is inputted is longer than the case where the detected temperature of the sub-thermistor 22 is below 80° C. Since the pressure roller 12 and the fixing film 11 rotate in a state in which the current supply is not provided to the heater 19, the temperature of the heater 19 continues to fall down. Then, at a point of the time when the detected temperature of the sub-thermistor 22 falls down till 80° C., the current supply to the heater 19 is started. In this manner, a cooling period is provided for allowing the pressure roller 12 and the fixing film 11 to rotate in a state in which the current supply to the heater 19 is not provided, and therefore, even when the current supply to the heater 19 is started thereafter, though the detected temperature of the sub-thermistor 22, that is, the temperature of the heater 19 reaches temporarily to the vicinity of 270° C. by over-shooting, it will not exceed the heat-resistance temperature 270° C. of the heater holder 20. Incidentally, in case the control shown in FIG. 17 is also performed, similarly to the case of FIG. 16, when the detected temperature of the main-thermistor 21 rises, the input power to the heater 19 is controlled, and therefore, the temperature (detected temperature of the sub-thermistor 22) of the heater 19 falls down with somewhere in the vicinity of 270° C. as a peak. After that, when the fixing processing is performed at the fixing nip portion N2, the detected temperature of the sub-thermistor 22 changes in the vicinity of 220° C.

Incidentally, over-shooting of the heater temperature at the time when the fixing nip portion is put into a state of FIG. 1A and the current supply to the heater 19 is started is smaller than the case of the second fixing mode. Hence, when the fixing nip portion is set to a state of FIG. 1A (the first fixing mode), the comparison with the above described reference temperature 80° C. is not performed, but the current supply to the heater 19 is also started at the same time the driving of the motor 1509 is started.

Experiment 1

By using the fixing apparatus of the present embodiment, a mutual paper feeding test of the standard plain paper and envelope was conducted. In case of using the plain paper, the fixing nip portion is set to a state of FIG. 1A, and in case of using the envelope, the fixing nip portion is set to a state of FIG. 1C. As the standard plain paper, a letter size paper of Premium Multipurpose 4024 Paper (basic weight 75 g/m$^2$) made by Xerox Corporation was used. Further, as the envelope, COM-10 #584 (basic weight 90 g/m$^2$) made by Mail Well Corporation was used.

Figure 18:
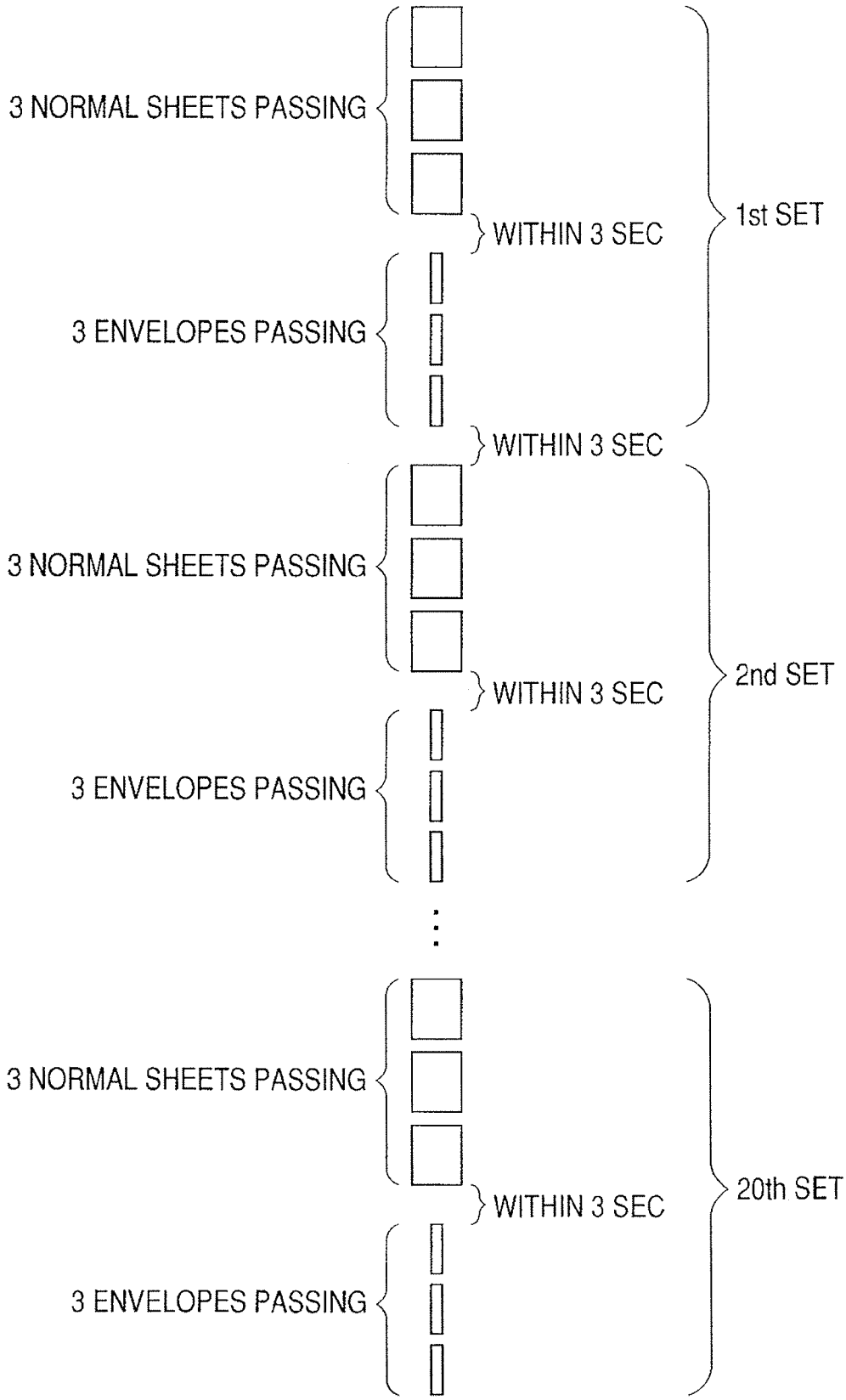
FIG. 18 is a view explaining a paper feeding sequence of a plain paper and an envelope conducted at an experiment for confirming the effect of the first embodiment.

By using the fixing apparatus of the present embodiment, the standard plain paper and envelope were mutually fed for every three papers without a pause. That is, as shown in FIG. 18, with the fixing nip portion in a state of FIG. 1A, the plain paper bearing the toner image is applied with a fixing processing in succession of three papers. After discharging the third plain paper, a print signal for processing the envelope within three seconds is transmitted to a printer engine. When the print signal for processing the envelope is inputted to the printer engine, the fixing nip portion is set to a state of FIG. 1C. At this time, as described above, the temperature is compared with the reference temperature 80° C., and a start timing of the current supply to the heater 19 is set. Then, the fixing nip portion applies the fixing processing to an envelope bearing the toner image in succession of three envelopes in a state of FIG. 1C. At a point of the time when the third envelope is discharged, the fixing processing for one set portion is completed, and within three minutes, the experiment proceeds to the next fixing processing.

After having performed such mutual paper feeding for 20 sets (a total of 120 papers), a solid image of yellow is formed on an over-head-projector transparent paper (OHT), and after that, it is applied with the fixing processing, and when a confirmation was made as to whether or not there is any image defect, no anomaly is found particularly. Further, when the fixing apparatus was disassembled, and a check was made as to whether or not there is any damage in component parts, no particular problem is found. That is, defects caused by deformation of the heater holder 20 and the like and abnormal temperature rising of the heater 19 were not found.

Incidentally, though the pressure adjustment mechanism of the present embodiment has provided three states of the normal pressure state, the half pressure state, and the separation state, there will be no inconvenience even if more pressure states are allowed to be set. Further, in the present embodiment, though the separation state is a state in which the fixing film and the pressure roller are separated, since it is a state set for convenience of jam processing, in reality, it may be allowed to be a state of slightly abutting against each other.

With regard to the image forming apparatus also, it is possible also to apply the fixing apparatus of the present invention not only to a color image forming apparatus but also to a monochrome image forming apparatus.

Further, in the present embodiment, though the power supply to the heater has been completely turned off at the cooling operating time, in case a sub-thermistor temperature at the cooling operation starting time is in the vicinity of 80° C., since it is often the case that the heater temperature is extremely lowered by performing the cooling operation and the torque is increased, there will be no inconvenience even if a slightly lower power is inputted to the heater 19 at the cooling operation time.

Further, as the fixing film in the present embodiment, a type of film having a base layer and elastic layer made of metal has been used. However, the present invention may be applied to the fixing film having only a base layer made of metal or a type of fixing film given with an extremely thin coating on the base layer made of metal. Further, there will be no inconvenience at all even if the present invention is applied to a type of fixing film using resin such as polyimide and the like instead of metal as the base layer.

Further, the temperature adjustment of the period other than the current supply starting time to the heater 19 as described above may be different from the plain paper feeding mode and the envelope mode. For example, since the envelope mode time is required to have a plenty of heat supply amount comparing to the plain paper, changes are possible such as setting the fixing temperature higher comparing to the plain paper mode or setting the driving speed of the fixing apparatus slower than the plain paper mode. Further, the cooling operation in the present embodiment is simply performed only by extending the rotation time of the fixing apparatus. However, in addition to this method, an airflow volume of the fan installed in the image forming apparatus may be increased. Alternatively, a flow of atmospheric current generated by the fan is changed only during the cooling operation, so that an airflow amount used for cooling the fixing apparatus may be increased.

Comparison Example 1

While the present comparison example uses the same fixing apparatus as the first embodiment, in the temperature control of the fixing apparatus, a cooling operation before the envelope feeding is not performed, and this is different from the first embodiment.

Figure 7:
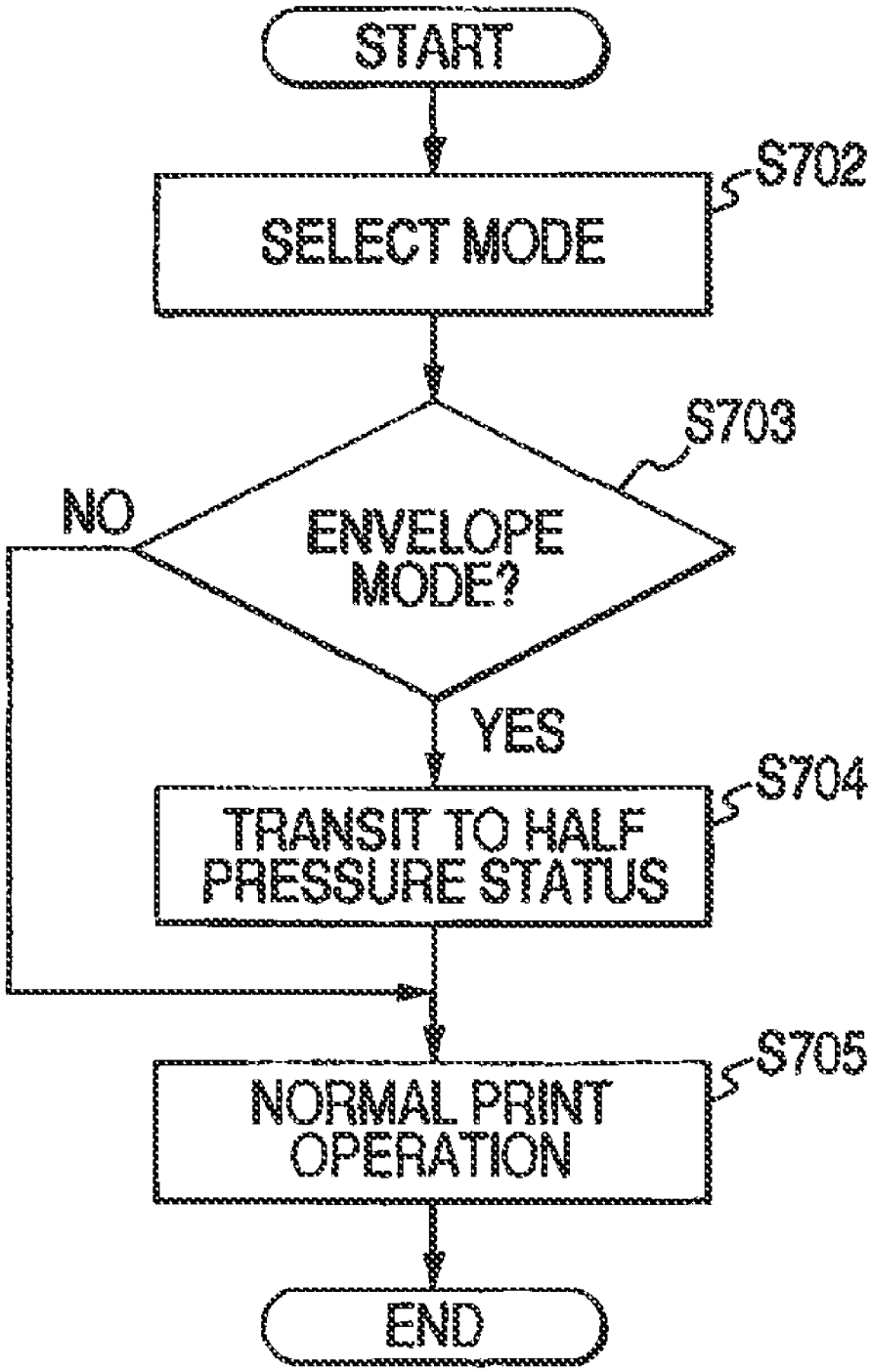
FIG. 7 is a flowchart showing the control of a comparison example.

Referring to FIG. 7, a part of the temperature control in the present comparison example will be described.

At step S702, selection of a mode is performed, and at step S703, it is determined whether or not the selected mode is an envelope mode. Then, regardless of whether or not the selected mode is an envelope mode, the rotation of the motor 1509 and the current supply to the heater 19 are both immediately started, so that the normal print operation is performed.

If it is determined at step S703 that the selected mode is an envelope mode, the steps S704 and S705 are performed, as shown in FIG. 7. If it is determined at step S703 that the selected mode is not an envelope mode, then step S705 is performed, as also shown in FIG. 7.

Figure 19:
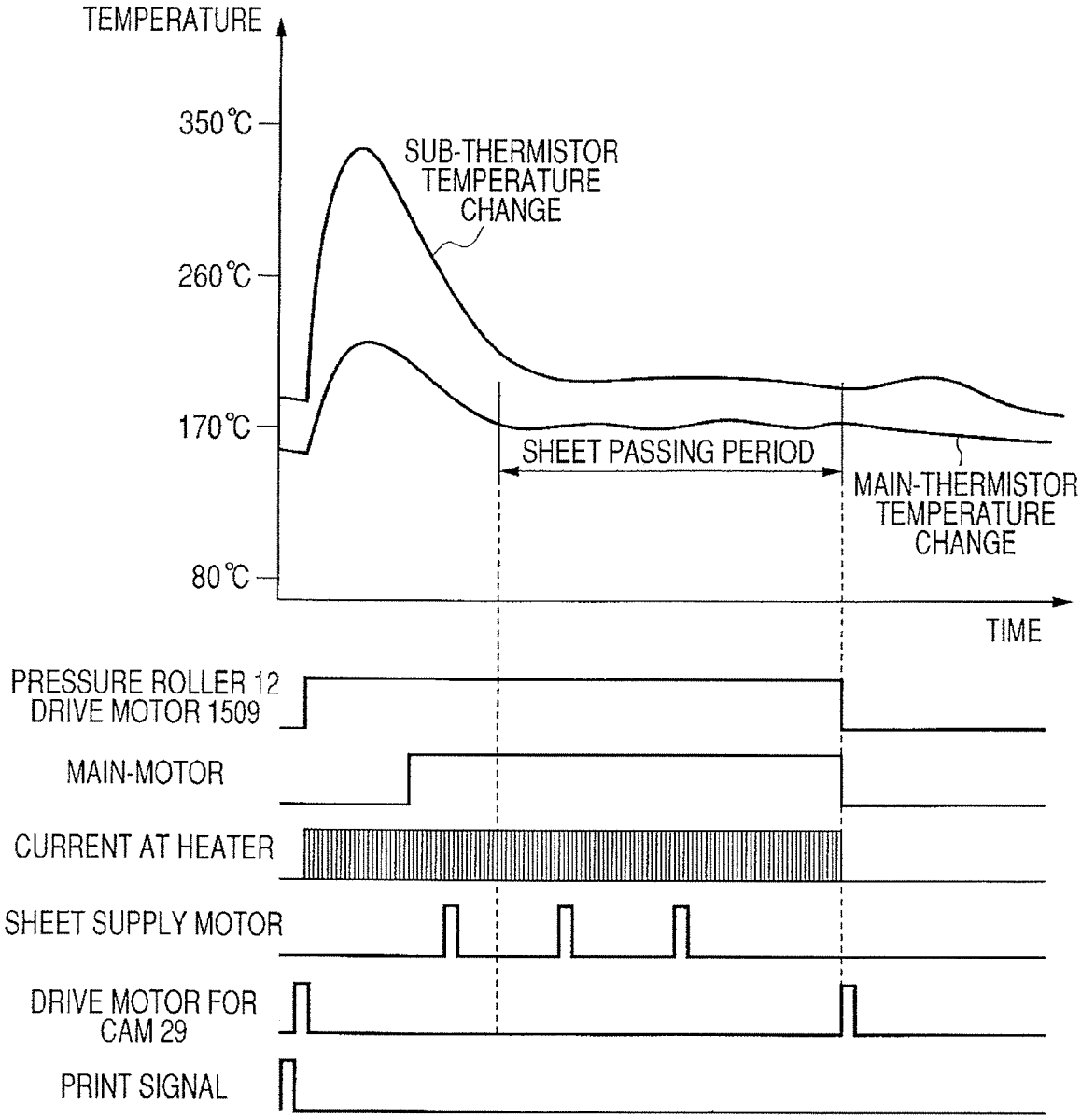
FIG. 19 is a view showing the operation of the comparison example in case the temperature of a heater 19 is above 80° C. when the fixing nip portion is set to a state of FIG. 1C and a temperature changes of the heater and the fixing film when this operation is executed.

FIG. 19 shows temperature changes of the main thermistor 21 and the sub-thermistor 22 in case of executing a second fixing mode (envelope mode) of the comparison example. This figure applies to the case where the temperature of the heater 19 is above 80° C. at the time when the fixing nip portion is set to a state of FIG. 1C.

In this comparison example, since the temperature is not compared to the reference temperature 80° C., regardless of the fact that the temperature of the heater 19 is above 80° C. at the time when the fixing nip portion is set to a state of FIG. 1C, the current supply to the heater 19 is started at the same time as the rotation of the motor 1509 is started. Hence, the detected temperature of the sub-thermistor 22, that is, the temperature of the heater 19 rises to the vicinity of 330° C. temporarily exceeding the heat resistance temperature 270° C. of the heater holder 20 by over-shooting.

Experiment 2

By using the same fixing apparatus as the experiment 1, a mutual paper feeding test of the standard plain paper and envelope similarly to the experiment 1 was conducted. After having conducted the mutual paper feeding for 20 sets, the OHT bearing a solid image of yellow was applied with the fixing processing, and it was found that permeability of the toner image of the end portion of the OHT in the width direction was extremely lowered. Further, when the fixing apparatus was disassembled, and a check was made as to whether or not there is any damage in component parts, the end portion of the holder in the longitudinal direction was molten, and the heater was deformed to be fitted into the heater holder. With this as a cause, in the end portion of the fixing apparatus, sufficient heat was not supplied to the fixing film, and the lowering of permeability of the end portion of the OHT was believed to be invited as a result.

As described above, in the present embodiment, in case the detected temperature of the second temperature detection element is higher than the reference temperature, the time before starting the fixing processing by the second fixing mode upon receipt of the print signal is longer than the time before starting the fixing processing by the second fixing mode in case the detected temperature is lower than the reference temperature. In this manner, defects such as the damage of the heater holder and the like can be controlled.

Second Embodiment

In the first embodiment, in case the second fixing mode is set, the detected temperature of the sub-thermistor after changing the fixing nit portion to the half pressure state (second pressure state) and the reference temperature are compared. In contrast to this, in the present embodiment, the detected temperature of the sub-thermistor before changing the fixing nip portion to the half pressure state (second pressure state) and the reference temperature are compared. In case the detected temperature of the sub-thermistor is above the reference temperature, a cooling operation is performed in a first pressure state as it is.

Figure 8:
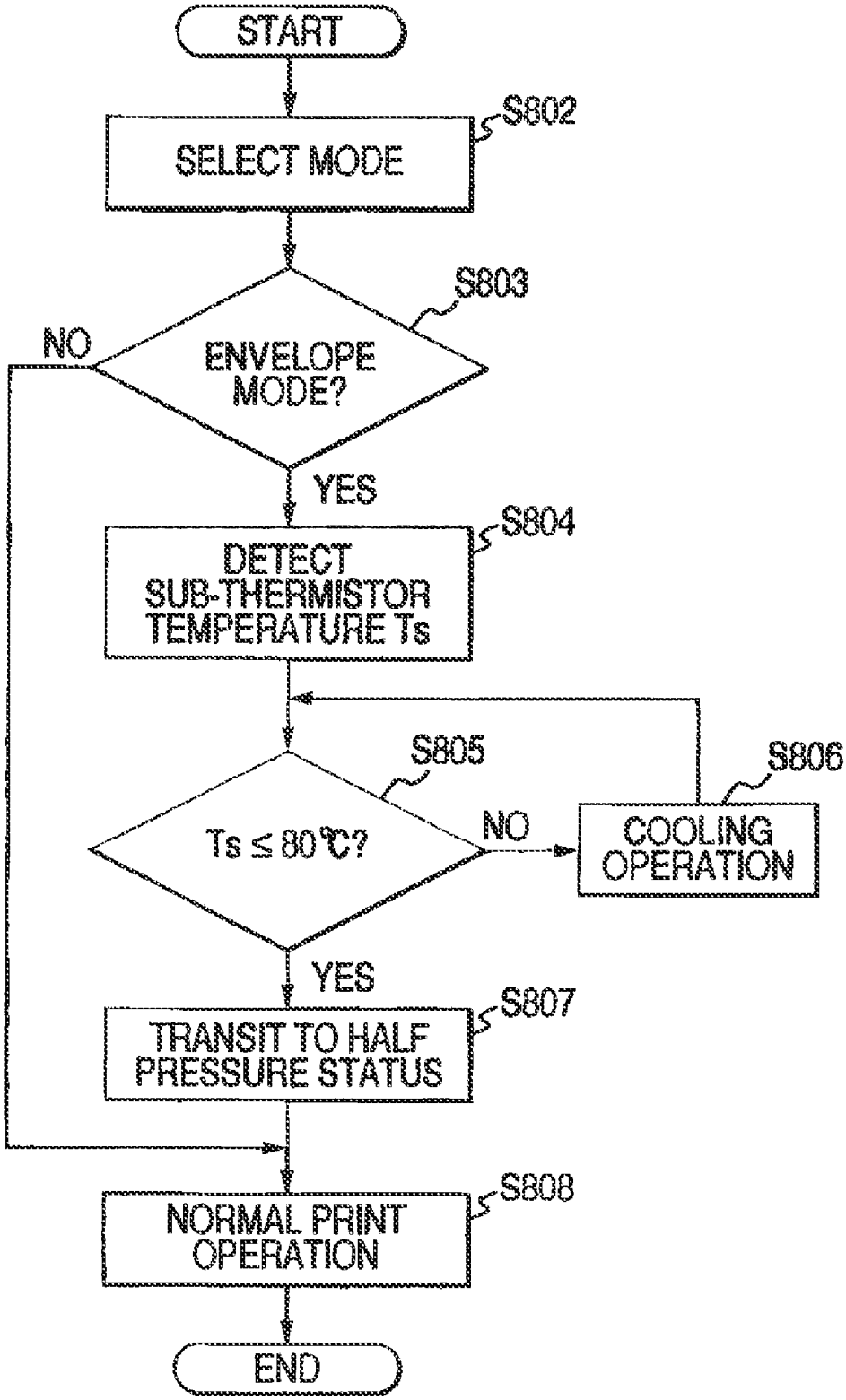
FIG. 8 is a flowchart showing the control of a second embodiment.

In FIG. 8 is shown a flowchart for explaining a part of the detail of a temperature adjustment control of the fixing apparatus in the present embodiment.

At step S802, selection of a mode is performed, and at step S803, it is determined whether or not the selected mode is an envelope mode. If the selected mode is not the envelope mode, at step S808, with the fixing apparatus set in the first pressure state as it is, the rotation of the motor 1509 and the current supply to the heater 19 are both started, so that the normal print operation is performed.

If the selected mode is an envelope mode, at steps S804 and S805, a detected temperature of the sub-thermistor is found. As a result, if the temperature of the sub-thermistor is above 80° C., at step S806, in the normal pressure state (first pressure state) as it is, a cooling operation is performed until the detected temperature of the sub-thermistor becomes below 80° C. If the temperature of the sub-thermistor is below 80° C., this cooling operation is not performed, and at step S807, the pressure adjustment mechanism is operated, and the fixing nip portion is put into the second pressure state, and after that, at step S808, similarly to the first embodiment, the current supply to the heater 19 is started, and the normal print operation is performed.

The detail of the cooling operation is the same as the first embodiment.

Incidentally, similarly to the first embodiment, when the fixing nip portion is set to a state of FIG. 1A (first fixing mode time), the comparison of the temperature with the reference temperature 80° C. is not performed, and the current supply to the heater 19 is also started at the same time with the start of the rotation of the motor 1509.

By performing a cooling operation in a normal pressure state similarly to the present embodiment, a heat volume transmitted from a fixing film unit to a pressure roller becomes large, and comparing with the case where a cooling operation is performed in a half pressure state, there is an advantage that the time required for cooling becomes short.

In the present embodiment, the maximum value of sub-thermistor temperature at the plain paper feeding time immediately before changing to the half pressure state is about 240° C. In case the cooling operation is performed after the fixing apparatus is changed to the half pressure state from this state similarly to the first embodiment, about 100 seconds are required to cool the sub-thermistor till 80° C. On the other hand, in case the cooling operation is operated in the normal pressure when the sub-thermistor temperature is 240° C. similarly to the present embodiment, the sub-thermistor temperature is lowered till 80° C. within approximately 60 seconds.

By using the fixing apparatus of the present embodiment, when the mutual paper feeding test of the same standard plain paper and envelope as the first embodiment is conducted, a result having no problem at all is obtained.

As described in the present embodiment, when the cooling operation is operated, it is performed in the normal pressure state, so that it is possible to shorten the time required for the cooling operation, and it is possible to provide the fixing apparatus of the image forming apparatus having much higher productivity.

Third Embodiment

The present embodiment is characterized by an operation where an envelope mode is selected during processing of a plurality of jobs, that is, a new job for printing an envelope is generated before an adjacent job (previous print processing) is completed. In the case of the present embodiment, it is not that a cooling operation is performed after the envelope mode is entered, but that the cooling operation is performed immediately after the job which is immediately before the envelope job. Then, after the cooling operation, the fixing apparatus proceeds to the envelope job. Incidentally, similarly to the first and second embodiments, after the print by the second fixing mode is completed, the phase of a cam 29 is controlled so that the pressure applied to the fixing nip portion is restored to the first pressure from the second pressure.

Figure 9:
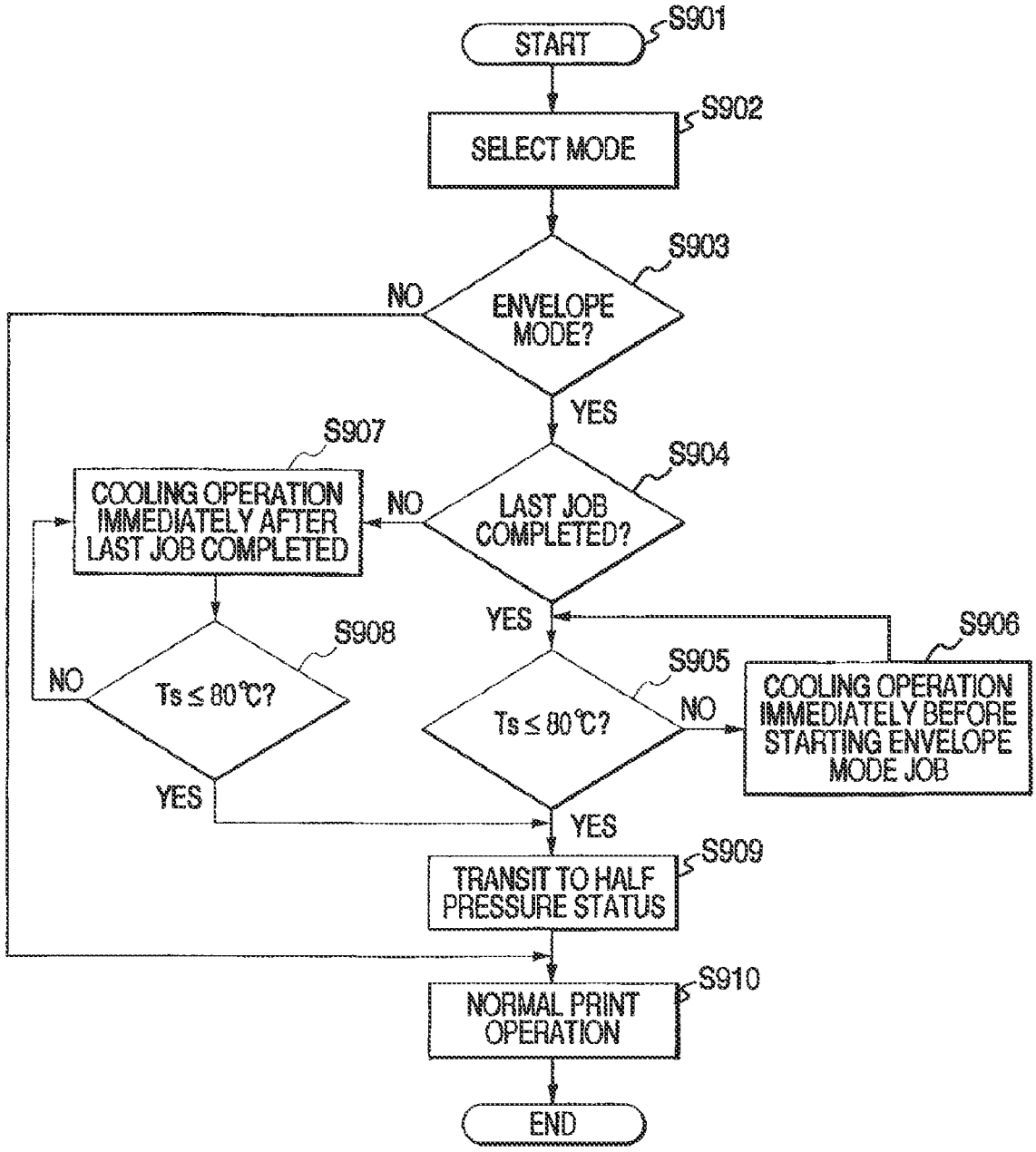
FIG. 9 is a flowchart showing the control of a third embodiment.

In FIG. 9 is shown a flowchart for explaining a part of the detail of a temperature adjustment control of a fixing apparatus in the present embodiment. Incidentally, in case the adjacent job is in the envelope mode (second fixing mode), even if a new job of the envelope mode is generated before the completion of this adjacent job, there is no need for the cooling operation for the new job of the envelope mode. Consequently, a description will be made on the assumption that the adjacent job is in a normal mode (first fixing mode), that is, at a point of time of step S901 of FIG. 9, the fixing nip portion is in the first pressure state.

In FIG. 9, at step S902, it is determined whether or not the envelope mode is selected as a new job. In case the envelope mode is selected as a new job, at step S903, it is determined whether or not the adjacent job is completed, at step S904, and in case the adjacent job is already completed, similarly to the first and second embodiments, at step S905, sub-thermistor temperature is detected, and it is determined whether or not the cooling operation is performed by the sub-thermistor temperature at step S906.

In case the adjacent job is not completed, at steps S907 and S908, the cooling operation is performed immediately after the adjacent job is completed.

The detail of the cooling operation, similarly to the second embodiment, is such that the fixing film and the pressure roller are driven without the power put into the heater 19, and at a point of the time when the detected temperature of the sub-thermistor becomes below 80° C., the fixing apparatus is stopped.

After the completion of the cooling operation of the fixing apparatus, at step S909, a pressure adjustment mechanism is operated and put into a half pressure state (second pressure state), and then at step S910, the driving of the motor 1509 and a current supply to the heater 19 are started, and feeding of the envelope is started.

By using the control method of the present embodiment, in case the envelope mode is selected before the adjacent job is not completed, the cooling operation is started at the completion time of the adjacent job, and the number of times for stopping the image forming apparatus can be diminished by one time, so that it is possible to shorten the time until changing to the envelope feeding.

When the mutual paper feeding test of the same standard plain paper and envelope same as the first embodiment is conducted by using the fixing apparatus of the present embodiment, a result having no problem at all is obtained.

As described in the present embodiment, when the cooling operation is performed, it is determined whether or not the adjacent job is completed, and in case the adjacent job is not completed, at the completion time of the adjacent job, the cooling operation is performed, so that the time required for the cooling operation is further shortened and the fixing apparatus of an image forming apparatus having high productivity can be provided.

Fourth Embodiment

In the present embodiment, when the envelope mode is selected in the first embodiment, after changing to the half pressure state, the driving speed of the fixing apparatus is made slower comparing to the normal mode time, so that sufficient fixability can be secured in the envelope mode also.

Figure 10:
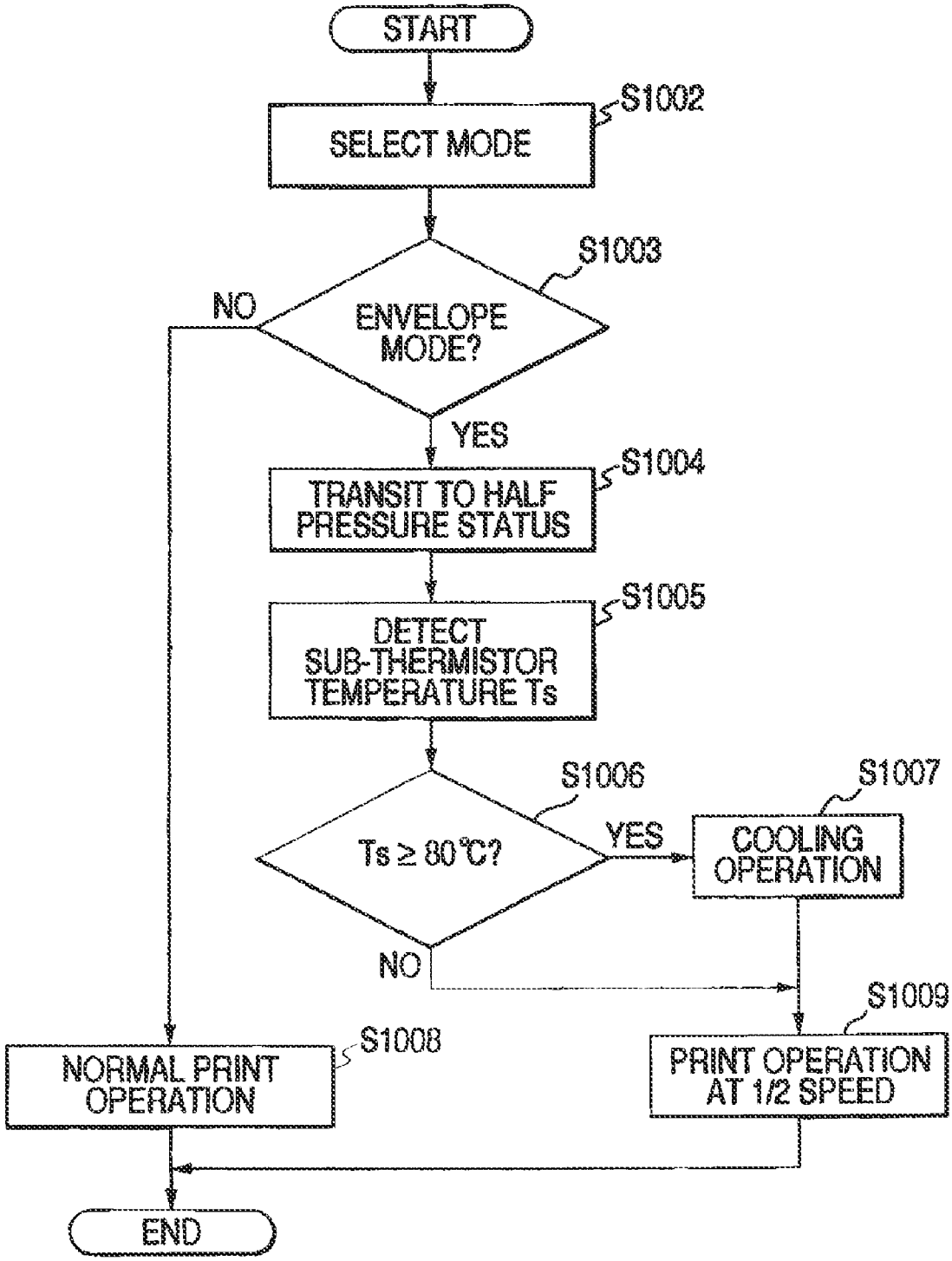
FIG. 10 is a flowchart showing the control of a fourth embodiment.

In FIG. 10 is shown a flowchart for explaining a part of the control detail of a fixing apparatus in the present embodiment.

At step 1002, selection of a mode is performed, and at step S1003, it is determined whether or not the selected mode is an envelope mode. If the selected mode is not an envelope mode, at step S1008, the rotation of a motor 1509 is started and at the same time a current supply to a heater 19 are started, so that a normal print operation is performed.

If the selected mode is an envelope mode, at step S1004, a pressure adjustment mechanism is operated, and a fixing nip portion is put into a half pressure state, and after that, at steps S1005 and S1006, a sub-thermistor detected temperature is found. As a result, if the sub-thermistor temperature is above 80° C., at step S1007, a fixing apparatus cooling operation is performed, and after that, a print is performed. A print speed at this time (step S1009) is half a speed of the normal time (first fixing mode), that is, the print is driven at 600 mm/sec.

Fixability of the toner on the envelope at this time is approximately the same as the case where the envelope is fed through at the first fixing mode (first pressure state and at 120 mm/sec). This is because the width in a conveying direction of the recording material of a fixing nip N2 in a half pressure state is about half of a fixing nip N1 of the normal time, and by dropping the fixing driving speed by half, the time during which the recording material receives heat from the fixing nip becomes approximately the same.

In contrast to this, in case the envelope is fed through at the same speed (120 mm/sec) as the first fixing mode in a second pressure state, though the envelope is fixed, a lack of fixability of the image develops in some cases at the place and the like which are superposed with solid images of toners of a plurality of colors, and it is often the case that a toner image becomes vacant by strongly rubbing the toner image after the fixing processing.

Incidentally, if the toner image on the envelope is fixed in the first pressure state and at the fixing speed of 120 mm/sec, though fixability is satisfied as described above, since the pressure is high, creases are prone to develop in the envelope. Hence, when the toner image on the envelope is applied with the fixing processing in the present embodiment, it is performed in the second pressure state and at the fixing speed of 60 mm/sec.

Fifth Embodiment

The present embodiment, similarly to the first embodiment, starts a current supply to a heater 19 when the detected temperature of a sub-thermistor 22 immediately after changing to a half pressure state is below 80° C. or the detected temperature of the sub-thermistor 22 after changing to the half pressure state is lowered to below 80° C. However, it is until the current supply to the heater 19 is started and the detected temperature of a main-thermistor 21 reaches a set temperature that an input power to the heater 19 is limited. In this manner, over-shooting at the start up time of the fixing apparatus in the half pressure state is further reduced, and the melting of a heater retaining member is made further difficult to occur.

The configuration of the fixing apparatus and the outline of the fixing apparatus control in the present embodiment confirm to the first embodiment. However, in the first embodiment, the power by which the heater 19 is inputted in the half pressure state (second pressure state) is the same as the power by which the heater 19 is inputted in a normal pressure state (first pressure state). That is, until the main thermistor detected temperature reaches a target (set temperature), 100% of the power is inputted.

In contrast to this, in the fixing apparatus of the present embodiment, the power inputted to the heater 19 by the time the main thermistor detected temperature reaches the target is limited to 50% in the case of the normal pressure state, and the power more than that limit is not inputted.

Figure 11:
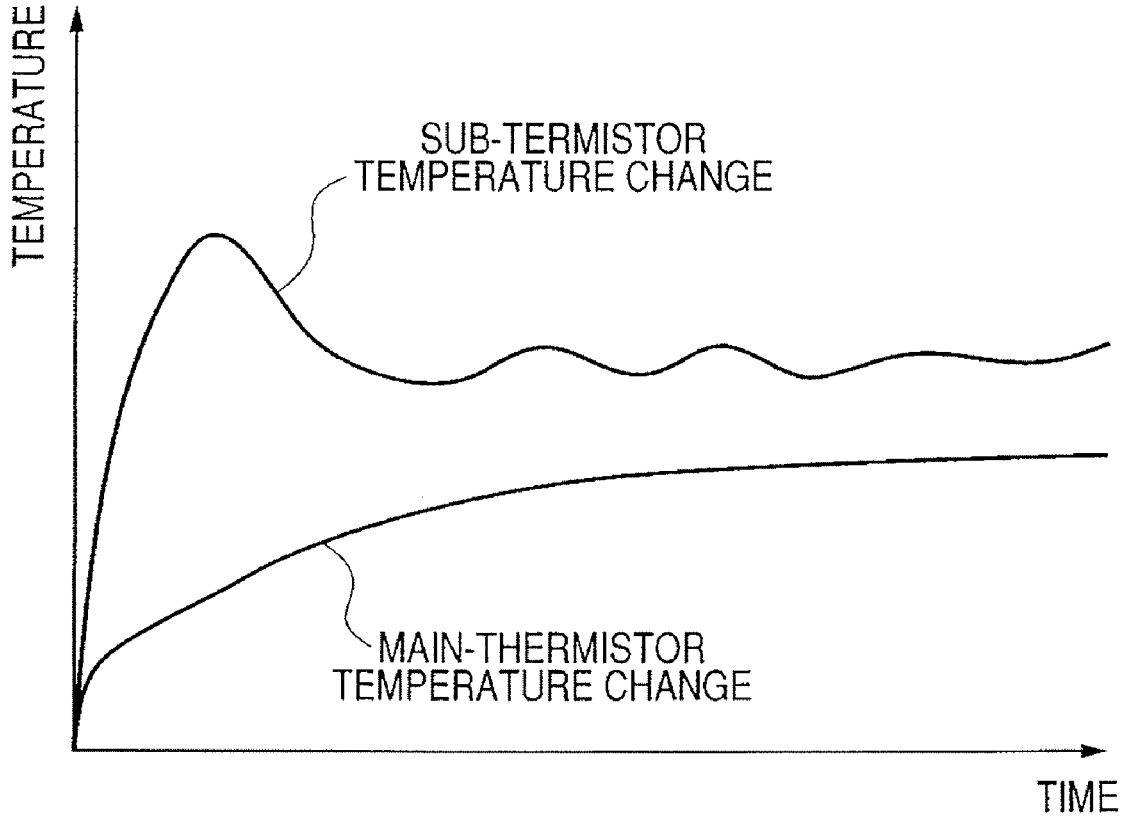
FIG. 11 is a graph showing a temperature changes of the heater and the fixing film when a fifth embodiment is executed.

In FIG. 11 is shown a graph, which monitors the main-thermistor detected temperature and the sub-thermistor detected temperature at this time, and plots them in the graph. As is evident by comparing the temperature change at the half pressure time of FIG. 5 with FIG. 11, it is clear that, though the startup time of the main thermistor temperature becomes slower by limiting the input power at the startup time in the envelope mode, over-shooting of the sub-thermistor becomes smaller, so that the problem of the melting of the heater retaining member becomes further difficult to arise.

Sixth Embodiment

The present embodiment performs a control of reducing a power supplied to a heater 19 by a definite value (offset power) immediately before a current supply is started to the heater 19 and a main-thermistor 21 reaches a target temperature.

Figure 12:
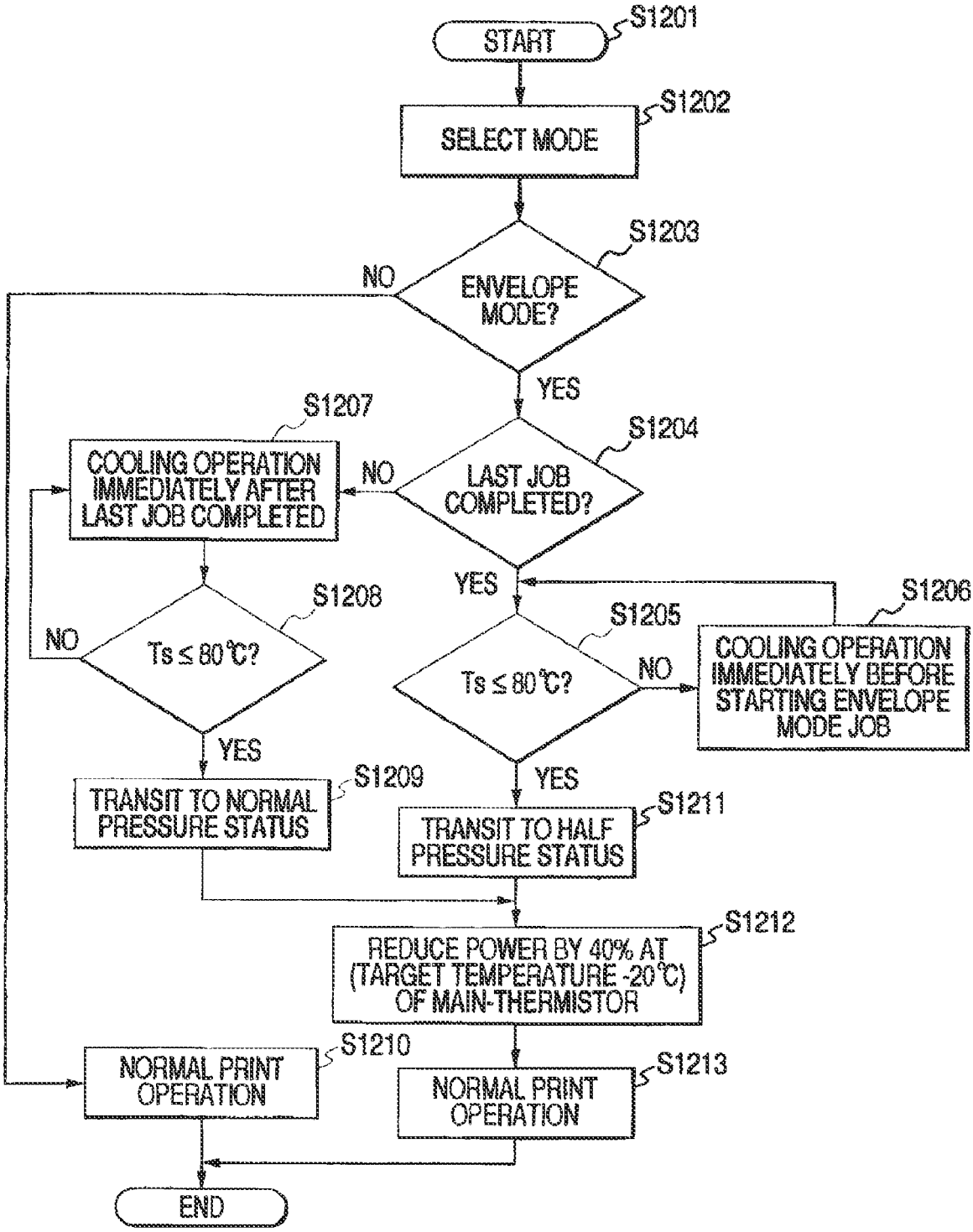
FIG. 12 is a flowchart showing the control of a sixth embodiment.

In FIG. 12 is shown a flowchart of a fixing control in the present embodiment. Incidentally, in case an adjacent job is in an envelope mode (second fixing mode), even if a new job of an envelope mode is generated before this adjacent job is completed, there is no need for a cooling operation for the job of the new envelope mode. Consequently, a description will be made on the assumption that the adjacent job is in a normal mode (first fixing mode), that is, at a point of time of step S1201 of FIG. 12, a fixing nip portion is in a first pressure state.

First, at steps S1202 and S1203, selection of a mode is performed. In the case when an envelope mode is not selected, a normal print operation is followed (step S1210). In the case when an envelope mode is selected and the adjacent job is not completed, similarly to the third embodiment, the cooling operation is performed (S1207 and S1208), and after stopping a motor 1509, the fixing apparatus proceeds to a half pressure state (S1209). In case an envelope mode is selected and the adjacent job is completed (step S1204), at step S1205, it is determined whether or not the cooling operation is performed, and the cooling operation is performed according to need (step S1206), and the rotation of the motor 1509 is stopped. After that, at step S1211, the fixing apparatus proceeds to a half pressure state. At step S1209 or S1211, after proceeding to the half pressure state, the rotation of the motor 1509 and the current supply to the heater 19 are started. At this time, at a point of time when the detected temperature of a main-thermistor reaches a target temperature minus 20° C., an input power is reduced by a definite amount (step S1212). The present embodiment performs an operation of reducing the input power by 40% for the power (100%) per a unit hour to be inputted until (target temperature −20° C.). After that, the same control as the normal print time is performed, and print is completed (step S1213).

Figure 13:
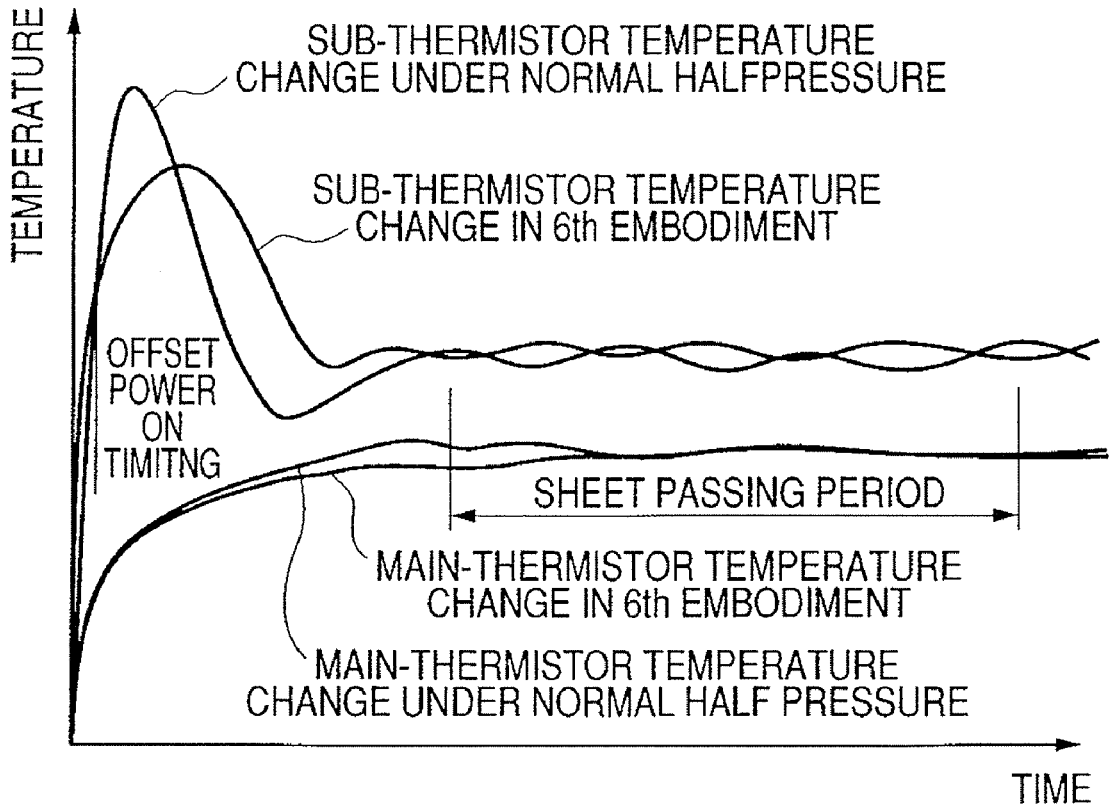
FIG. 13 is a graph showing a temperature changes of the heater and the fixing film when the sixth embodiment is executed.

The detected temperature behaviors of the main-thermistor and the sub-thermistor at this time are shown in FIG. 13. As shown in FIG. 13, at a time of point when the detected temperature of the main thermistor detects a target temperature minus 20° C., the input power is reduced, so that it is found that the startup speed of the sub-thermistor becomes dull and over-shooting becomes small. In contrast to this, the main-thermistor temperature is not affected so much as the sub-thermistor, and fixability is also good.

In the present embodiment, only when the envelope mode is selected, a power offset is performed at a point of time when the main-thermistor temperature reaches the target minus 20° C. In the normal print time (first fixing mode time) other than the envelope mode time also, the power offset of an amount smaller than the envelope mode time may be performed in order to prevent over-shooting. For example, at a point of time reaching the (target temperature −20° C.), a control of reducing the power by 20% for the power (100%) per unit hour inputted till the (target temperature −20° C.) may be performed.

Seventh Embodiment

The present embodiment is characterized in that, in order to further control over-shooting generated at the time when a recording material rushes into a fixing nip, an amount by which the power offset is made immediately before the recording material rushes into the fixing nip is made different for a normal mode and an envelope mode.

In general, since a feedback control represented by a PID control consists of detecting a fluctuation of controlled variable and adding a manipulated variable corresponding to thereto, after detecting the controlled variable, the temperature of the fixing film takes a time until reaching an appropriate temperature after adding the input power. Because of this, over-shooting and under-shooting are prone to occur.

Particularly, immediately after the recording material rushes into the fixing nip, since heat is abruptly deprived from a fixing film to a recording material, a big power is inputted, so that over-shooting is prone to occur.

Hence, immediately before the recording material rushes into the fixing nip, a heat quantity to be deprived by the recording material is estimated in advance, and by providing a control of adding a power for that deprived portion, over-shooting of the fixing apparatus is prevented, thereby performing a stable temperature adjustment control.

Figure 14:
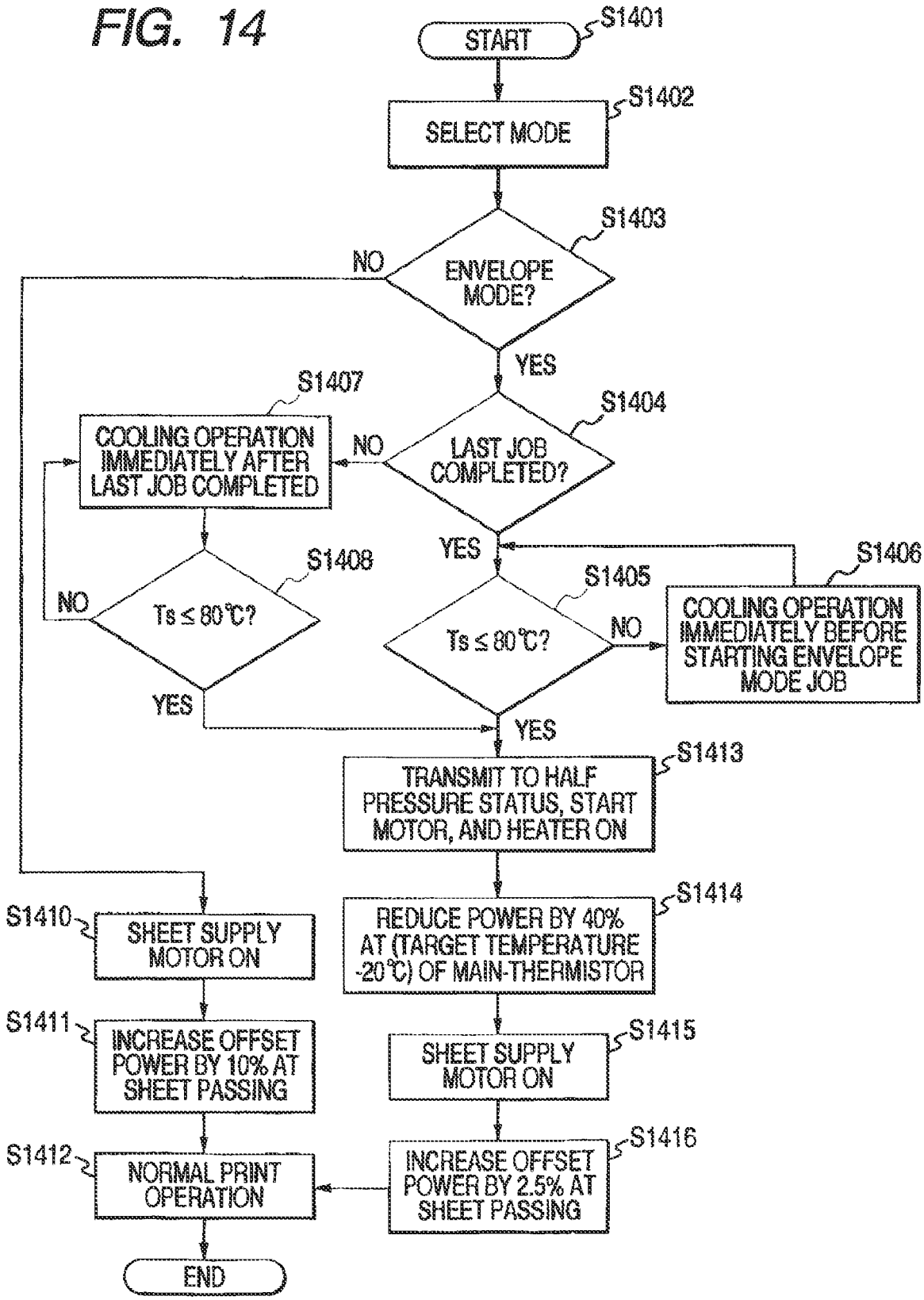
FIG. 14 is a flowchart showing the control of a seventh embodiment.

In FIG. 14 is shown a flowchart for explaining a control of the fixing apparatus in the present embodiment. Incidentally, in case the adjacent job is in an envelope mode (second fixing mode), even if a new job of envelope mode is generated before this adjacent job is completed, there is no need for a cooling operation for the new job of envelope mode. Consequently, a description will be made by presuming that the adjacent job is in a normal mode (first fixing mode), that is, at a point of time of step S1401 of FIG. 14, the fixing nip portion is in a first pressure state.

In FIG. 14, after a mode is selected at step S1402, at step S1403, it is determined whether or not an envelope mode is selected. In case an envelope mode is not selected, a normal print operation is entered (steps S1410, S1411, and S1412), and immediately before the recording material rushes into the fixing nip, the power is added by +10% (hereinafter referred to as paper feeding time offset power) for the power (100%) per unit hour inputted till (target temperature −20° C.), thereby continuing the normal print (S1411 and S1412). A timing for adding the paper feeding time offset power is set at a point of time one round this side of the fixing film.

At step S1403, the envelope mode is selected. In case when it is determined that the adjacent job is completed (step S1404), at step S1405, necessity of the cooling operation is determined, and the cooling operation is performed according to need (step S1406). In case the adjacent job is not completed, at steps S1407 and S1408, the cooling operation is executed. At step S1413, the fixing apparatus proceeds to a half pressure state, and after that, the rotation of a motor 1509 and a current supply to a heater 19 are both started. In the present embodiment also, similarly to the sixth embodiment, at step S1414, at a point of time when the temperature of a main thermistor reaches a target minus 20° C., the power is reduced by 40% for the power (100%) per unit hour inputted till (target temperature −20° C.), thereby taking measures to meet over-shooting. After that, by the timing immediately before the recording material rushes into the fixing nip (step S1415), a paper feeding time offset power is added (S1416). The envelope is narrow in width in the direction orthogonal to a conveying direction comparing to a plain paper, and due to the fact that a heat quantity deprived from the fixing film to the envelope is relatively small and the width of the fixing nip in the conveying direction is also narrow in the case of the envelope mode (second fixing mode), a heat quantity deprived from the fixing film becomes further small. Hence, the paper feeding time offset power added by the second fixing mode is smaller than the case of the first fixing mode. An adding amount of the paper feeding time offset power in the envelope mode of the present embodiment is 2.5% for the power (100%) per unit hour inputted till (target temperature −20° C.). Consequently, the power inputted to the heater 19 from a point of time when a leading end of the envelope reaches one round this side of the fixing film for the fixing nip portion is (100−40+2.5=) 62.5%. From this, over-shooting due to excess of the paper feeding time offset power is not generated and an appropriate fixing control can be performed.

The present invention is not limited by the above described embodiments, and includes various modifications within the scope of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application Nos. 2005-217457 filed on Jul. 27, 2005 and 2005-217454 filed on Oct. 5, 2005, 2006-189246 filed on Jul. 10, 2006, which are hereby incorporated by reference herein.

The invention claimed is:

1. An image fixing apparatus for fixing an image formed on a recording material, comprising:

a heater;

a sleeve having an inner peripheral surface contacted with said heater;

a backup member for forming a fixing nip portion with said heater through said sleeve;

a first temperature detection element for detecting a temperature of said sleeve;

a second temperature detection element for detecting a temperature of said heater;

a current supply control portion for controlling a current supply to said heater so that the detection temperature of said first temperature detection element maintains at a set temperature; and a pressure adjustment mechanism for adjusting a pressure applied to the fixing nip portion, said pressure adjustment mechanism being capable of setting the pressure applied to the fixing nip portion to a first pressure and a second pressure lower than the first pressure;

wherein said fixing apparatus is capable of setting a first fixing mode for executing a fixing process under the first pressure and a second fixing mode for executing the fixing process under the second pressure, and wherein in case the detection temperature of said second temperature detection element before starting the fixing process under the second fixing mode is higher than a reference temperature, a time period from upon receipt of the print signal until starting the fixing process under the second fixing mode is longer than the case where the detection temperature is lower than the reference temperature.

2. The image fixing apparatus according to claim 1, wherein in case the detection temperature of said second temperature detection element before starting the fixing process under the second fixing mode is higher than the reference temperature, a cooling operation for rotating said sleeve is performed without proving the current supply to said heater during the time period from upon receipt of the print signal until starting the fixing process under the second fixing mode.

3. The image fixing apparatus according to claim 1, wherein in case the detection temperature of said second temperature detection element before starting the fixing process under the second fixing mode is higher than the reference temperature, a cooling operation for cooling said heater is performed by activating a cooling fan during the time period from upon receipt of the print signal until starting the fixing process under the second fixing mode.

4. The image fixing apparatus according to claim 2 or claim 3, wherein the cooling operation is executed before the pressure applied to the fixing nip portion is set to the second pressure.

5. The image fixing apparatus according to claim 1, wherein a fixing process speed of the second fixing mode is slower than the first fixing mode.

6. The image fixing apparatus according to claim 1, wherein the current supply to said heater is started in order to execute the second fixing mode, and when the detected temperature of the first temperature detection element reaches a temperature lower than the set temperature, an input power per unit period to said heater is reduced.

7. The image fixing apparatus according to claim 6, wherein after the input power to said heater is reduced, the input power is increased immediately before the recording material enters into the fixing nip portion.

8. The image fixing apparatus according to claim 7, wherein a timing for increasing the input power is set when a leading end of the recording material reaches a position where a distance until the fixing nip portion is equivalent to approximately one round of said sleeve.

* * * * *